US005240561A

United States Patent [19]

Kaliski

[11] Patent Number: 5,240,561

[45] Date of Patent: Aug. 31, 1993

[54] ACID-TO-ALKALINE PAPERMAKING PROCESS

[75] Inventor: Adam E. Kaliski, East Windsor, N.J.

[73] Assignee: Industrial Progress, Inc., East Windsor, N.J.

[21] Appl. No.: 932,663

[22] Filed: Aug. 20, 1992

Related U.S. Application Data

[63] Continuation-in-part of Ser. No. 836,220, Feb. 10, 1992, abandoned.

[51] Int. Cl.[5] ..... D21H 17/70

[52] U.S. Cl. ..... 162/138; 162/146; 162/158; 162/162; 162/164.1; 162/168.1; 162/169; 162/181.1; 162/181.2; 162/181.6; 162/181.9

[58] Field of Search ..... 162/183, 138, 146, 158, 162/164.1, 162, 168.1, 169, 181.1, 181.2, 181.6, 181.9

[56] References Cited

U.S. PATENT DOCUMENTS 3,128,223 4/1964 Von Rosenberg et al. ..... 162/181.7

4,954,220 9/1990 Rushmere ..... 162/181.6

*Primary Examiner*—Peter Chin

*Attorney, Agent, or Firm*—Sachs & Sachs

[57] ABSTRACT

A fundamentally new papermaking process for the manufacture of paper, board and other wet-laid products on a paper machine under conditions ranging from acidic to alkaline from aqueous furnishes treated with in-situ-synthesized complex functional microgels.

10 Claims, No Drawings

ACID-TO-ALKALINE PAPERMAKING PROCESS

This application is a continuation-in-part of the patent application Ser. No. 07/836,220 ("Acid-to-Alkaline Papermaking Process"), filed Feb. 10, 1992 now abandoned.

BACKGROUND OF THE INVENTION

Field of the Invention

This invention relates to a fundamentally new papermaking process, based on a fundamentally new flocculation mechanism different from charge-neutralization or polymer-bridging known in the prior art.

Specifically, this invention relates to a process for the manufacture of novel and improved paper, board and other wet-laid products from furnishes comprising cellulosic and/or synthetic fibers, optionally also comprising inorganic and organic filler pigments, water-soluble and water-disperse polymer adhesives, color dyes and other adjuvants, treated with complex functional microgel cements.

The complex functional microgel cements are synthesized in situ (in the furnish) from transient, chemically reactive subcolloidal sodium-silico-aluminate or similar hydrosols cross-linked with bivalent and/or multivalent inorganic salts, optionally also using organic, cationically active chemical compounds having at least two reactive groups in each molecule as auxiliary (additional) cross-linking agents.

Discussion of the Relevant Art

Paper, as a web of cellulosic fibers, is made in principle by dewatering aqueous suspensions (furnishes) of partially crushed (refined) cellulosic fibers on stationary or moving screens and drying the resultant screen residue.

The quality of paper products made in the above manner would obviously be unacceptable for most of today's applications; hence, modern papermaking furnishes usually consist of blends of selected species of cellulosic fibers, refined to precisely defined standards; mineral and/or plastic filler pigments; dyes; sizing agents; strength-enhancing polymers; and so forth, the resultant webs being appropriately finished. To obtain satisfactory retention of solids from such complex furnishes on rapidly moving and vibrating forming screens of modern paper machines, these furnishes must be flocculated in a controlled manner with the aid of appropriate colloid-chemical mechanisms. The type of flocculation-controlling mechanism depends on the system of chemical agents ("wet-end chemicals") specific to the papermaking process employed.

As is readily understood by those skilled in the art, there can be only as many principal, fundamentally different papermaking processes as there are principal, fundamentally different flocculation mechanisms, the only two such flocculation mechanisms known in the prior art being based on either charge neutralization or polymer bridging. Accordingly, the two principal papermaking processes at the foundation of the entire contemporary papermaking industry, depending on two fundamentally different colloid-chemical mechanisms (wet-end chemistries) for furnish flocculation, are the "acidic" process, known since ancient times, and the "alkaline" process, known for just a few decades.

The flocculation of furnish ingredients in the acidic papermaking process is induced with the aid of papermaker alum (aluminum sulfate), which requires that the pH level in the furnish be maintained below 5.3. It is only below the pH of 5.3 that alum dissociates into trivalent cations, $Al^{3+}$, which effectively suppress the negative charges on furnish particulates causing their flocculation. To maintain a precise control of the pH level in the furnish, alum is often used in combination with sulfuric acid. A dose of about 20–30 lbs. of alum per ton of furnish solids is usually sufficient to flocculate the latter and obtain satisfactory solids retention on the forming wire. High-molecular-weight organic cationic polymers are often employed as auxiliary flocculants, in proportions of from 1 to 4 lbs. per ton of furnish solids, to increase the efficiency of solids retention.

To counter the inherent drawbacks of the acidic papermaking process, an alkaline version of the papermaking process was developed in the past few decades and is now replacing the former to an ever growing extent. The most pronounced drawbacks of the acidic papermaking process traditionally have been manifested in the low mechanical strength and poor aging characteristic of paper products, along with severe adverse environmental side effects. The alkaline papermaking process, whose wet-end chemistry relies upon the use of special functional high-molecular-weight polymers (retention aids), is carried out as a rule at a furnish pH ranging from about 7 to 8, although somewhat higher or lower pH levels are not uncommon. The fundamental colloid-chemical mechanism employed for furnish flocculation in the latter process is based on "polymer bridging," according to which the relatively long macromolecular chains of the above-mentioned high-molecular-weight polymeric retention aids become attached directly to receptive sites on the surface of cellulosic fibers and/or filler particles. As the effect of polymer bridging, manifested by the "tying" of adjacent particulates with polymer chains, ensembles of flocculated matter are formed which can be retained efficiently on the forming wire of a paper machine.

Although the alkaline papermaking process is free of the major drawbacks of the acidic process, it nevertheless has some serious drawbacks of its own. A most serious one is the former's inherent inability to cope with the emerging technological trends and advancements taking foothold in the paper industry. These new trends and advancements aim, among other things, toward vastly increased paper machine speeds, on the order of 6,000–8,000 ft/min; formation of webs from significantly more concentrated furnishes than those presently used; total closure of process-water streams on paper machines; manufacture of "high-ash" printing papers with filler-loading levels ranging from 25% to more than 50%, by weight; manufacture of high-quality on-machine-coated papers; as well as manufacture of ultraopaque papers (having opacities of at least 98%) for two sided, high-resolution computer printout and office reproduction. It is thus fair to state that the alkaline papermaking process of the prior art, although a relatively very recent newcomer to the paper industry, has been "born senile" at the very onset as far as its technological growth potential is concerned.

The papermaking process of the present invention relies on an instantaneous (for all practical purposes), indiscriminate and complete flocculation of any and all particulates present in papermaking furnishes with the aid of in-situ synthesized multicomponent, functional complex microgels disclosed by the applicant in the co-pending patent application Ser. No. 07/919,831 ("Functional Complex Microgels with Rapid Formation Kinetics"), filed Jul. 27, 1992, incorporated herein by reference. The complex microgels in question are synthesized in principle by cross-linking in-situ-formed transient, chemically reactive sodium-silico-aluminate and similar subcolloidal hydrosols with the aid of bivalent and/or multivalent inorganic salts.

The above in-situ (in the papermaking furnish) synthesized complex functional microgels used in practicing the present invention are believed to represent the most powerful and versatile colloid-chemical systems known in the colloid science and technology. Although many thousands of seemingly analogous colloidal systems were described and/or patented during the past 150 years, the applicant is not aware of any even remotely resembling the complex functional microgels under discussion with regard to either the chemical composition, ultrarapid formation kinetics, colloid-chemical nature or application versatility.

The inescapable deficiency of all paper products made by the prior-art acidic and alkaline papermaking processes is the lack of a truly uniform distribution of the highly diversified particulate matter present in papermaking furnishes used for these products' manufacture. As is readily understood by those skilled in the art, paper products with a uniform structure (statistically uniform spatial distribution of all particulate components) can be obtained only if all of the following conditions are fulfilled:

(a) starting with papermaking furnishes in which all particulate ingredients (fibers, fiber fines, fillers) are optimally (for all practical purposes) dispersed, the statistically uniform distribution of the particulates in question being sustained intact prior to flocculation;

(b) flocculating the optimally dispersed particulate components of papermaking furnishes from step (a) instantaneously (for all practical purposes), indiscriminately and completely to retain an equivalent statistically uniform distribution of furnish particulates in the resultant flocs; and (c) providing an adequate mechanical integrity to the resultant flocs, enabling the latter to effectively withstand the shearing forces to which they may be exposed while the flocculated furnish is conveyed to the headbox or applied onto the forming wire of a paper machine.

The mechanical integrity in question is attainable by generating flocs with an adequate inherent tenacity or imparting to these flocs the ability to reform (reconstitute) after a transient breakup. It should be further emphasized in the above context that the use of well-dispersed, let alone optimally dispersed, furnishes in the acidic and alkaline papermaking processes of the prior art, required by condition (a) above, is technically infeasible for all practical purposes in that the flocculation mechanisms at the foundations of both of the above processes are too weak to override the action of the powerful modern dispersants. Moreover, the wet-end chemistry of an "ideal" papermaking process should also provide, in addition to the flocculating action, an intrinsic mechanism for enhancing the resultant paper products, mechanical strength, and even for imparting desirable functional properties. As is well known to those skilled in the art, however, the wet-end chemistries of the acidic and alkaline papermaking processes of the prior art have, for all practical purposes, none of the above-mentioned "ideal" features which represent but a few of the many attractive and important benefits provided by the versatile papermaking process of the present invention.

Although there is no direct prior art whatsoever relating to the acid-to-alkaline papermaking process of the present invention, to the best of the applicant's knowledge, references will be made hereinafter to any even indirectly related technical and patent literature deemed helpful to elucidating the subject matter under discussion.

In accordance with the foregoing and disclosures to follow, it is an object of the present invention to provide a working description of a fundamentally novel acid-to-alkaline papermaking process, based on a fundamentally new, hitherto unknown flocculation mechanism, allowing one to manufacture improved or entirely novel paper, board and wet-laid nonwoven products from furnishes treated with in-situ synthesized complex functional microgels having intrinsic cementing and surface-chemistry-modifying properties.

In particular, it is an object of the invention to provide a working description of the wet-end chemistry of the papermaking process under discussion, relying on the use of the complex functional microgels disclosed in the co-pending patent application Ser. No. 07/919,831 ("Functional Complex Microgels with Rapid Formation Kinetics"), filed Jul. 27, 1992, applicable to a whole spectrum of tasks extending from laboratory-scale handsheet making up to full-fledged production runs on even the fastest paper machines.

It is a further object of the invention to provide novel approaches to the manufacture of paper, board and wet-laid nonwoven products on paper machines utilizing essentially 100% of the particulate matter, such as fibers or fillers, present in the starting furnishes, thus obtaining effluent streams free of particulate contaminants.

It is a still further object of the invention to provide novel approaches to manufacturing more uniform webs at faster paper machine speeds than is possible with the aid of the acidic and alkaline processes of the prior art.

It is a yet further object of the invention to provide novel approaches to manufacturing very uniform webs on paper machines, using considerably more concentrated furnishes than can be employed in the acidic and alkaline papermaking processes of the prior art, hence, greatly reducing the enormous water demand inherent to the latter processes.

It is a yet further object of the invention to provide novel approaches to attaining the environmentally most desirable goal of a total closure of process-water streams on paper machines.

It is a still further object of the invention to provide novel approaches to the manufacture of cellulosic webs with a superior resistance to aging.

It is a further object of the invention to provide novel approaches to the manufacture of high-temperature-resistant wet-laid ("nonwoven") products.

It is a yet further object of the invention to provide novel methods of "intrinsic" sizing of cellulosic webs.

It is a still further object of the invention to provide novel approaches to attaining filler-retention efficiencies exceeding those presently feasible with the aid of the acidic and alkaline papermaking processes of the prior art.

It is a yet further object of the invention to provide novel approaches to manufacturing "very-high-ash"

papers with filler-loading levels even exceeding 50%, by weight.

It is a yet further object of the invention to provide novel approaches to manufacturing colored cellulosic and wet-laid nonwoven webs, while utilizing essentially 100% of the color dyes employed.

It is a still further object of the invention to provide novel approaches to the manufacture of webs readily accepting (dissipating) both water and organic liquids.

A yet further object of the invention is to provide novel approaches to the manufacture of cellulosic webs whose dry and wet strengths surpass those attainable with similar webs made with the aid of the acidic or alkaline papermaking processes of the prior art.

A still further object of the invention is to provide novel approaches to manufacturing extra-high-strength cellulosic and other wet-laid products from furnishes optionally comprising, besides cellulosic and/or synthetic fibers, one or more of additional ingredients such as synthetic microfibrils, extraneously prepared novel cellulosic microfibrils, novel ultrafine polymer-emulsion adhesives and novel waterborne rubber cements.

It is a yet further object of the invention to provide novel approaches to manufacturing under alkaline conditions groundwood-containing paper products, including newsprint, of a quality not attainable with the aid of the papermaking processes of the prior art.

It is a still further object of the invention to provide novel approaches for manufacturing ultraopaque paper (with an opacity of at least 98%) for high-resolution, two-sided computer printout and office reproduction.

A yet further object of the invention is to provide a general blueprint for custom designing novel approaches to the manufacture of a variety of paper, board and other wet-laid products on a paper machine, having better quality and/or being made faster and more economically than analogous products made with the aid of the acidic and alkaline processes of the prior art, as well as to provide novel approaches to making entirely new types of paper, board and other wet-laid products whose manufacture was hitherto not feasible with the aid of the technologies and materials known in the prior art.

SUMMARY OF THE INVENTION

The present invention relates to a fundamentally new acid-to-alkaline process for manufacturing paper, board and other wet-laid products on a paper machine, from aqueous furnishes having a pH of from 4.5 to 12 (the alkaline and near-subalkaline pH range being preferred for practicing the present invention), wherein said process comprises the following steps:

(a) blending an aqueous solution of an alkali-metal or quaternary ammonium silicate, and a second aqueous solution of an alkali-metal aluminate and/or alkali-metal zincate, with a paper, board or wet-laid-nonwoven furnish to form in situ a transient, chemically reactive subcolloidal hydrosol, wherein each of said solutions is employed in said furnish at a concentration of from 0.01% to 2.0%, by weight;

(b) blending an aqueous solution of at least one cross-linking agent selected from the group consisting of bivalent and/or multivalent inorganic salts, said aqueous solution optionally containing at least one additional (auxiliary) cross-linking agent selected from the group consisting of organic cationically active chemical compounds with at least two reactive groups in each molecule, with the resultant furnish from step (a), said cross-linking agent(s) being employed in said furnish at a concentration of from 0.02% to 4.0%, by weight, to cross-link said transient chemically reactive subcolloidal hydrosol and synthesize in situ a complex functional microgel cement, whereupon all particulate components of said furnish become flocculated instantaneously, indiscriminately and completely;

(c) optionally purging said furnishes resulting from step (b) of dissolved contaminants, e.g., with the aid of filtration and rinsing; and (d) recovering said furnishes resulting from steps (b) and/or (c) to manufacture paper, board or other wet-laid (non-woven) products on a paper machine.

The in-situ-synthesized microgels from step (b), further in the specification and in the claims to follow referred to in the generic terms, regardless of their specific chemical composition, as complex functional microgels or microgel cements, are employed in proportions of from 0.4% to 10%, by weight, as determined by ashing, in relation to the mass of the resultant paper, board or wet-laid nonwoven products, wherein the constituents of said microgel cements are (a) from 0.4% to 10%, by weight, in relation to the total mass of paper, board or wet-laid-nonwoven furnish solids, of transient, chemically reactive subcolloidal hydrosols formed of
  (1) at least one reagent selected from the group consisting of alkali-metal silicates and quaternary ammonium silicates; and
  (2) at least one reagent selected from the group consisting of alkali-metal aluminates and alkali-metal zincates, the ratio of the reagents of (1) to the reagents of (2) being from 1:10 to 10:1, by weight; cross-linked by (b) at least one cross-linking agent selected from a first group consisting of bivalent and multivalent inorganic salts, employed in a proportion of from 0.4% to 10.0%, by weight, in relation to the total mass of paper, board or other wet-laid products, and, optionally, at least one auxiliary cross-linking agent selected from a second group consisting of organic, cationically active chemical compounds having at least two reactive groups in each molecule, employed in a proportion of up to 0.5%, by weight, in relation to the total mass of paper, board or other wet-laid products, the ratio of said cross-linking agents to said chemically reactive, subcolloidal hydrosols being from 1:10 to 10:1.

In addition to cellulosic and/or synthetic fibers and customary disperse and/or water-soluble functional adjuvants used in papermaking, the above-mentioned furnishes for making paper, board and other wet-laid products optionally comprise at least one of the following materials in proportions specified below in relation to furnish solids:

(a) filler pigments, up to more than 50%, by weight;
(b) color dyes, up to 5.0%, by weight;
(c) carbon black, deagglomerated by the masterbatch method, up to 01%, by weight;
(d) commercial latex adhesives with an average particle diameter larger than 70 nm, up to 5.0%, by weight;
(e) novel ultrafine acrylic polymer-emulsion adhesives with an average particle diameter smaller than 55 nm and a glass-transition temperature ranging from −60° C. to +20° C., up to 5.0%, by weight;

(f) novel waterborne acrylic rubber cements, up to 5.0%, by weight;
(g) waterborne disperse thermoplastic adhesives, up to 20.0%, by weight;
(h) commercial water-soluble wet-end adhesives, up to 2.0%, by weight;
(i) synthetic microfibrils, up to 2.0%, by weight;
(j) cellulosic microfibrils with a length of from 10 μm to 200 μm, prepared extraneously by the cascade microfibrillation process, up to 2.0%, by weight; and
(k) ultrafine electroconductive and/or magnetic ceramic and/or metallic powders with particle diameters finer than 0.2 μm, up to 20.0%, by weight.

DESCRIPTION OF THE PREFERRED EMBODIMENTS

In the preferred mode of practicing the present invention, novel and improved paper, board and other wet-laid products are manufactured on paper machines from aqueous furnishes comprising cellulosic and/or synthetic fibers, optionally also comprising at least one functional ingredient such as inorganic and organic pigments, organic polymer adhesives, color dyes and other adjuvants useful in papermaking, dispersed and/or dissolved in said furnishes, by flocculating all particulate furnish ingredients instantaneously, indiscriminately and completely with the aid of the above-mentioned, in-situ-synthesized complex functional microgels which, in terms of secondary functions, also contribute (by virtue of their cementing properties) to the dry and wet strengths of the resultant cellulosic or wet-laid nonwoven webs. The microgels (microgel cements) in question, disclosed in the previously mentioned copending patent application Ser. No. 07/919,831, filed Jul. 27, 1992, are formed in two distinct process stages, a different polymerization mechanism being active in each stage.

In the first process stage, two separate reagent solutions are introduced into an aqueous furnish comprising cellulosic and/or synthetic fibers, optionally also containing filler pigments, water-disperse and/or water-soluble adhesives, dyes and other water-disperse and/or water-soluble adjuvants (auxiliary functional materials). One of these reagent solutions contains an alkali-metal or quaternary ammonium silicate, preferably sodium silicate. The other reagent solution contains an alkali-metal aluminate and/or alkali-metal zincate, preferably sodium aluminate. An immediately commencing addition polymerization of the above "primary" subcolloidal-hydrosol-forming reagents leads to the formation of sodium-silico-aluminate (zincate) dimers, trimers and higher-rank oligomers. These transient, chemically reactive anionic polymer precursors remain, for a limited period, in a very specific state of solution. for which the objectively fitting term "subcolloidal hydrosols" has been employed herein.

In the second process stage, an aqueous solution containing at least one cross-linking agent selected from the group consisting of essentially colorless, bivalent and/or multivalent salts of calcium, magnesium, barium, aluminum, zinc and zirconium, preferably calcium chloride or nitrate, is introduced into the above-mentioned furnish containing the subcolloidal hydrosol formed in the first process stage. The polycondensation reaction taking place between the transient, chemically reactive subcolloidal sodium-silico-aluminate (zincate) hydrosols and the inorganic cross-linking salts leads to an ultrarapid formation of complex (multicomponent) calcium-silico-aluminate (zincate) or similar microgel cements, made up of networks of macromolecules of a polymer-polycondensate type.

The colloidal consequence of synthesizing the complex microgel cements used in practicing the present invention in in-situ, in the furnish, is an instantaneous, indiscriminate and complete flocculation (coflocculation) of any and all particulates present in the furnish. The tenacity of the evolving flocs can often be enhanced, improving the efficiency of fines retention on the forming wire, by incorporating small proportions of cationic polyelectrolytes into the solutions of the above-mentioned inorganic bivalent and/or multivalent cross-linking salts.

It should be emphasized that the primary reagents used in the first stage of the process of the formation of the complex microgels, i.e., sodium silicate and sodium aluminate (zincate), must first react with each other to form the transient, chemically reactive subcolloidal sodium-silico-aluminate (zincate) hydrosols before any complex microgels can be synthesized (in the second stage of the process) by cross-linking the subcolloidal hydrosols in question with bivalent or multivalent inorganic salts. Hence, the subcolloidal sodium-silico-aluminate (zincate) hydrosols which, along with the inorganic cross-linking salts, are the factual microgel-forming agents, must be considered as "higher-rank" reagents synthesized in situ from the primary, lower-rank reagents, i.e., sodium silicate and sodium aluminate (zincate). If the latter individual reagents reacted directly (on their own) with a cross-linking salt, e.g., calcium chloride, the products of such reactions would be merely suspensions, or precipitates, of solid, more or less crystalline particles of bicomponent calcium silicate and calcium aluminate (zincate), respectively, but not microgels, let alone complex microgels which, by definition, must contain at least three different chemical building blocks in their macromolecular make-up.

The complex functional microgels used in practicing the present invention are formed virtually instantaneously, the chemical reaction of polycondensation between the above-mentioned low-molecular-weight subcolloidal hydrosols and the bivalent and multivalent inorganic salts being estimated to occur in less than one microsecond. The consequences of this polycondensation are further manifested in a very rapid propagation of association between calcium-silico-aluminate (polymer-polycondensate) macromolecules, bringing about, within a couple of milliseconds, the development of colloidal formations with useful molecular weights that may reach billions. It is primarily this rapid continuous growth of the molecular weights across such an enormously broad range, "sweeping" through the entire reaction space, which is deemed responsible for the instantaneous, indiscriminate and complete flocculation of even the most heterodisperse and polydisperse colloidal systems known in the art, regardless of these systems' physical, chemical or colloidal make-up.

The quantitative aspects of the unique flocculating power of the in-situ-synthesized complex microgels under discussion can be readily understood considering that the efficiency of organic polymeric flocculants, such as are routinely employed in the acidic and alkaline papermaking processes of the prior art, increases markedly with the increasing molecular weight. As is well known to those skilled in the art, however, the use of polymeric flocculants with a molecular weight higher than about 15,000,000 is often difficult, if not impossible, due to their limited solubility in water. Moreover, all organic polymeric flocculants have relatively narrow molecular-weight distributions and are thus incapable of satisfying "across-the-board" the highly differentiated flocculation requirements inherent to such pronouncedly heterodisperse and polydisperse systems as the contemporary furnishes for making paper and other wet-laid products. On the other hand, the complex microgels under discussion possess such an across-the-board (universal) flocculating ability in that, being synthesized in situ and growing continuously from the very smallest dimensions, they sweep through an enormously broad molecular-weight range. It would obviously be impossible to introduce analogous extraneous high-molecular-weight polymeric flocculants into a paper (nonwoven) furnish because of insolubility.

While the complex (multicomponent) microgels used in practicing the present invention were completely unknown heretofore, the transient, chemically reactive subcolloidal hydrosols used for synthesizing these microgels need some elaboration to distinguish them from other, deceptively similar systems of the prior art. In view of the confusion and lack of standardization in the present colloid-chemical terminology, a fundamental treatment of the subject matter of the present invention and a brief chronological review of the prior art related to this subject matter is deemed necessary.

It is essential to point out in the above context that an active worldwide interest in natural and synthetic silica and silico-aluminates commenced with the key discoveries of 1) water-soluble sodium silicates ("water glass") by Johann Nepomuk von Fuchs (1774–1856), who suggested numerous practical applications for these interesting chemicals, e.g., in application to the formulation of adhesives, cements, flame retardants for paints, detergents, soap builders, dyeing adjuvants, metal fluxes and fertilizers;
2) metallic aluminum in 1825 by Oerstedt and Woehler, with most of the inorganic chemical compounds of this element known today having been described in the professional literature by countless scientists within the next few decades; and
3) the phenomena of ion exchange in soils (natural alumino-silicates) by J. T. Way in 1850.

The rapidly following discoveries of many other commercially valuable properties of silica and alumino-silicate minerals, e.g., in the application to the desiccation of gases, clarification of water, removal of color impurities from edible and mineral oils, or manufacture of pigments and catalysts, triggered intensive research efforts in the field of silica and alumino-silicates. These efforts were directed both towards improving the performance properties of naturally occurring materials as well as producing analogous or yet unknown synthetic materials with yet more improved or even entirely novel properties.

Due to the similar dimensions of ionic radii of $Si^{4+}$ and $Al^{3+}$ (0.4 Å and 0.50 Å, respectively), as well as an overwhelming abundance of these two elements in the lithosphere, a large variety of alumino-silicate minerals have been synthesized in nature by geochemical processes. In contrast, the more complex (comprising three or more components) minerals related to alumino-silicates, exemplified by the previously mentioned calcium-alumino-silicates, are relatively uncommon in nature. The reason for the rare occurrence of calcium-alumino-silicate minerals, such as anorthite, $Ca[Al_2Si_2O_8]$, or margarite, $CaAl_2[Al_2Si_2O_{10}][OH]_2$, is readily understood considering that $Ca^{++}$, with an ionic radius of 0.99 Å, is rather strongly rejected from an evolving alumino-silicate matrix, making the formation of such complex minerals by the exceedingly slow geochemical processes difficult.

Since no significant practical applications have yet been found for calcium-alumino-silicate minerals, an in-depth exploration or synthesis of the latter generated thus far only a limited interest from the standpoint of academic or industrial research. On the other hand, a great number of aluminosilicate preparations and products were synthesized in the past 150 years because of the latters, highly diversified commercial applications. That such an enormous variety of chemical compounds, characterized by distinct physical and colloidchemical properties, can be synthesized using just one or two of the four simple, easily available reagents, i.e., sodium silicate, silicic acid, sodium aluminate and alum, has absolutely no precedent in the inorganic chemistry. The almost countless patents issued in the past 150 years for a broad variety of synthetic silica and alumino-silicate products obtained with the aid of the above-mentioned reagents relate essentially to only three principal colloidal systems, namely, continuous gels and discrete sols and precipitates.

The incredible diversification of the forms and properties of products synthesized with the aid of the same few reagents may be explained by accepting the hypothesis that colloids are the lowest-rank systems known in nature equipped with "memory." It is the latter which makes the colloids "remember" their history in chronological detail and react accordingly, as manifested in terms of their resultant material properties and functional behavior. Hence, any intentional, or even accidental, deviation from established synthesis procedures or reaction conditions will bring about inescapably certain differences, mostly quantitative but sometimes profoundly qualitative, in the constitution and/or functional properties of the resultant colloidal systems. Indeed, essentially all similar, or even virtually identical, patented synthetic silica and alumino-silicate products differ among each other merely with respect to relatively minor quantitative compositional variations, procedural modifications (such as may pertain to the rates, order of addition and concentrations of reagents, pH ranges, as well as thermal and aging regimes), or with respect to the resultant products, modified physical and physicochemical properties and new areas of application.

How even a minor processing detail may be decisive to the very usefulness of a synthetic alumino-silicate product may be illustrated, for example, by Paquin U.S. Pat. No. 2,757,085. As disclosed therein, satisfactory color-reactive alumino-silicate pigments, synthesized in situ in a papermaking furnish, were obtained only if sodium aluminate was introduced into the furnish first, followed by the addition of sodium silicate, but not vice-versa. Similarly, Williams et al. U.S. Pat. No. 4,213,874 teaches that it was possible to synthesize satisfactory amorphous sodium aluminosilicate base exchange materials only if, among other things, the proper sequence and rate of addition of the reactants were maintained during the precipitation process.

The critical dependence of a successful preparation of colloidal systems on maintaining strictly defined process parameters and conditions is perhaps best summarized by S. Voyutsky in his textbook of *COLLOID CHEMISTRY* (Page 269, second paragraph), Mir Publishers, Moscow, translated into English in 1978: "Colloidal systems can be obtained by various chemical reactions: exchange, reduction, oxidation, hydrolysis, and so forth. But colloidal systems are not always formed in reactions capable of producing sols; they are formed only (underlining added by the applicant) at definite concentrations of the initial substances, at definite order of their mixing and temperature, and when some other conditions are met."

The preferred transient, chemically reactive subcolloidal hydrosols used in practicing the present invention are soluble sodium-alumino-silicates which form spontaneously when solutions of sodium silicate and sodium aluminate are blended into aqueous slurries of particulate raw materials (furnishes) used for the manufacture of cellulosic or wet-laid nonwoven products by the papermaking process under discussion. As the result of an immediately commencing addition polymerization, dimers, trimers and higher-rank oligomers (polymer precursors) evolve sequentially and continuously into very-low-molecular-weight sodium-alumino-silicate macromolecules of an anionic polyelectrolyte type. Due to the relatively low concentrations of the reagents employed, but mostly due to the prompt cross-linking of the transient subcolloidal hydrosols (terminating their further molecular growth), the evolving sodium-alumino-silicate macromolecules are very small, their estimated dimensions being at most only slightly larger than 1 nm (10 Å).

Such highly disperse systems represent special borderline solutions classified dimensionally above solutions of crystalloids (simple molecules or ions), but below colloidal solutions, e.g., those of starch, protein or polyacrylamides. A scientifically appropriate term "subcolloidal hydrosols" has been systematically used herein in referring to the above systems, which should be distinguished from aquasols (hydrosols) of the prior art which are aqueous suspensions of solid particles with diameters of from about 5 nm to 100–200 nm.

Historically, the terminology used in colloid science and technology evolved in connection with the basic investigative tools available at the inception of colloidal research, namely, the conventional light microscope and ultramicroscope. Colloidal particles with diameters smaller than 200 nm could hardly be resolved with the aid of old-fashioned light microscopes equipped with low-aperture objectives; hence, they were referred to as "submicroscopic." On the other hand, ultramicroscopes, utilizing the Tyndall effect, made it possible to observe, though not resolve, particles as small as 5 nm in diameter. Consequently, colloidal systems became traditionally the domain of ultramicroscopical investigations and their classification as "ultramicroscopic," with particle dimensions ranging from 5 nm to 200 nm, still has a great deal of validity for most practical applications. Regrettably, some less rigorous colloid textbooks still routinely list the colloidal dimensions as extending from 1 nm to 500 nm, or even 1000 nm.

Modern scientific research has established unequivocally, however, that the traditional delineation between "colloidal" and "noncolloidal" (crystalloid) systems, established solely on the basis of the dimensions of particles of the disperse phase, has no scientific foundation. Hence, contemporary doctrines refute the concept of "colloids" and "crystalloids," interpreted in the past in a rather absolute sense, accepting instead the existence of a very specific "colloidal state" associated with disperse systems conforming to the established criteria of "colloid-like" behavior. The reasons for this can be illustrated rather clearly using the example of sodium chloride which behaves as a typical crystalloid in aqueous solutions and a typical colloid in benzene solutions, numerous other such systems already having been identified.

Many experimental findings made during studies of highly disperse systems attest particularly clearly to the uniqueness of the particle-dimension interval extending from 1 nm to 5 nm (10–50 Å), in which the colloidal and crystalloid states overlap and deficiencies of the imperfect colloid-chemical nomenclature are most evident. Hence, an unambiguous treatment of disperse systems of the above type frequently makes defining them in fundamental terms virtually mandatory, as has been established in dealing with many extremely important media such as surfactants, dyes, toxins and antitoxins. For example, the dimensions of individual molecules of some of the above-mentioned materials are larger than 1 nm (10 Å), considered as the conventional upper limit of crystalloid particles, but smaller than 5 nm (50 Å), considered as a practical lower limit for typical colloidal particles. Since the behavior of such systems overlaps the domains of both crystalloids and colloids, some authors have introduced the rather artificial term "semicolloids" to deal with these unusual solutions. Still other authors refer to such highly disperse systems, with particle dimensions ranging from 1 nm to 5 nm, as "amicrons" (subcolloids), to be distinguished from "submicrons" applying to systems with particles larger than 5 nm in diameter.

Perhaps the most unfortunate aspect of the traditional colloid-chemical terminology is that the term "aquasol," and the equivalent term "hydrosol," in which the suffix "sol" stands for "solution," are used in referring to suspensions of ultramicroscopic solid particles in water. Although aquasols (hydrosols) do indeed appear as translucent (opalescent) solutions to an unaided eye, the latter, fundamentally incorrect, terms complicate the clarity of the issue when the scientific discourse revolves around boundary systems of overlapping behavior (e.g., crystalloid/subcolloid or subcolloid/colloid) or extends beyond professional circles. It should be pointed out, though, that many rigorous colloid scientists systematically employ the scientifically correct term "suspensoids" in referring to aquasols (hydrosols) of the prior art.

The above-mentioned, nomenclature-related problems become even more complicated in dealing with novel subject matter, such as the subcolloidal sodium-silico-aluminate or similar hydrosols used to synthesize the complex microgels at the foundation of the present invention. The latter subcolloidal hydrosols constitute borderline solutions of transient, chemically reactive polyanionic molecules. As solutions, they have the appearance of completely clear, plain water, are totally devoid of any solid particles and do not exhibit the Tyndall effect.

The transient character of these continuously changing subcolloidal sodium-alumino-silicate hydrosols renders the underlying oligomers and macromolecules fundamentally undefinable in terms of the exact physical dimensions or chemical composition. This is understood best when considering that the reaction of addition polymerization, commencing with the moment the solutions of sodium silicate and sodium aluminate become introduced into a reactor (furnish), proceeds continuously. Hence, even if it were possible to determine, at any given instant, the dimensions, molecular weights, or chemical composition of the evolving macromolecules, such information would become obsolete in the very subsequent instant.

It is possible, however, to objectively define the unique systems mentioned above employing criteria of the philosophy of science used in formulating scientific definitions. According to these criteria, the continuously changing, transient, subcolloidal hydrosols cannot be classified as "materials" in a conventional sense in that they have no definite (fixed) form, mass or properties by which a material is conventionally described or defined, e.g., in textbooks of material science. Instead, the latter subcolloidal systems, representing a very specific "material state," are defined in terms of (a) a detailed description of the reaction medium and conditions at the onset of the synthesis of the subcolloidal hydrosols in question, i.e., at the point of time (t) where t=0; and (b) an arbitrary subsequent fixed point of time (t=c). The latter means that if the in-situ synthesis of an arbitrary transient subcolloidal hydrosol is initiated at a time t=0, using identical reagents, reagent proportions and concentrations, sequences and rates of reagent addition, temperature, pH and all other effective reaction conditions and process parameters, then, and only then, the resultant transient subcolloidal hydrosol will be exactly the same each time it passes through a subsequent fixed point of time t=x (x=c).

While the above-discussed continuously evolving (in statu nascendi) subcolloidal systems, e.g., the transient subcolloidal sodium-alumino-silicate hydrosols under discussion, are undefinable in conventional terms used in material sciences, it is also completely certain that they are different from any existing natural or synthetic substances of the same nominal chemical compositions. By contrast, all traditional sols are classified as "phaseal" colloids, the latter term indicating that the disperse phase is identical to an analogous phase existing on a macro scale and could, in principle, be obtained from the latter with the aid of mechanical comminution or other preparatory methods.

The transient aspects of the subcolloidal sodium-alumino-silicate hydrosols used in practicing the present invention must be particularly strongly emphasized since the process of addition polymerization between sodium silicate and sodium aluminate is a continuous one. Hence, at some advanced stage of polymerization (aging), particles of the above-mentioned subcolloidal hydrosols acquire sufficiently high molecular weights to exceed the solubility limits, whereupon the subcolloidal hydrosols in question transform into conventional (prior-art) aquasols, i.e., colloidal suspensions of solid particles. The period of aging necessary to initiate such a transformation may extend from less than a second up to several days, or even weeks or months, depending on the concentration of sodium silicate and sodium aluminate (zincate) in the reaction medium (furnish), and is manifested by the appearance of the Tyndall effect.

As is readily understood by those skilled in the art, the chemical reactivity of the transient subcolloidal hydrosols in question, i.e., the ability to form the complex microgels at the foundation of the present invention by a process of chemical cross-linking carried out with the aid of bivalent (multivalent) inorganic salts, decays with the increasing degree of polymerization (aging). The chemical reactivity is lost almost completely when the solute particles of the above subcolloidal hydrosols polymerize beyond the solubility limits transforming into solid colloidal particles of conventional sols. It is important, therefore, that the second stage of the in-situ synthesis of complex microgels, in which the above-mentioned subcolloidal sodium-alumino-silicate or similar hydrosols are chemically cross-linked with the aid of bivalent and/or multivalent inorganic salts, be carried out before the advent of the Tyndall effect.

In typical paper mill installations working in a continuous process mode, the above cross-linking can be carried out within a period ranging from several seconds to a couple of minutes, counting from the moment the solutions of sodium silicate and sodium aluminate are added to furnishes for making paper, board and other wet-laid products.

The primary purpose of the in-situ synthesized complex functional microgels under discussion is to induce an instantaneous, indiscriminate and complete flocculation (coflocculation) of all disperse raw materials present in paper, board or wet-laid-nonwoven furnishes. Flocculation phenomena play a fundamental role in the manufacture of cellulosic and wet-laid nonwoven products; however, the flocculation processes used in the acidic and alkaline papermaking processes of the prior art are slow, detrimentally selective (rather than indiscriminate) and incomplete. Accordingly, these processes are not well suited for the manufacture of advanced paper, board and wet-laid nonwoven products (especially at high paper machine speeds) that are free of detrimental consequences of a selective flocculation and fractionation of furnish components according to species and size, manifested in more or less pronounced performance deficiencies of the resultant products. As a matter of fact, many potentially useful ultrafine colloidal materials cannot, for all practical purposes, be flocculated (precipitated) with the aid of the inefficient flocculation processes and agents used in prior-art acidic and alkaline papermaking processes, thus being effectively eliminated as viable raw materials for manufacturing the above-mentioned advanced paper, board and wet-laid nonwoven products.

Typical contemporary paper furnishes are highly heterodisperse and polydisperse waterborne systems containing cellulosic fibers and fiber fines, inorganic and organic fillers, water-soluble adhesives, sizing agents, dyes, and other adjuvants. All of the above furnish ingredients must be uniformly coflocculated to be efficiently retained on the forming wire of a paper machine and yield satisfactory (uniform) webs. As is well known, however, each disperse component of a heterodisperse system has different surface-chemical properties, electrical-charge density, dispersion stability, and so forth, hence, also a different resistance to flocculation. Moreover, virtually all particulate species used in paper furnishes are more or less polydisperse in their own right, the process of flocculation of dimensionally different component fractions of these species being controlled by different colloid-chemical and other mechanisms. Considerable difficulties are encountered in particular when flocculating inherently polydisperse mineral fillers whose particle dimensions may range from about 0.1 μm to 20 μm e.s.d. (equivalent spherical diameter). Hence, coarse filler fractions, e.g., those with an equivalent spherical diameter larger than 2 μm, are relatively resistant to colloid-chemical flocculation their retention in the web being affected primarily by mechanical factors such as turbulence, gravitational settling, or filtration. The flocculation of intermediate-size fractions, on the other hand, is effected mainly by the neutralization of electrical charges on filler particles and by polymer bridging. The ultrafine filler fractions, i.e., those with an equivalent spherical diameter smaller than 0.1 μm, are hardly affected by the flocculation mechanisms employed in the acidic and alkaline papermaking processes of the prior art. Similarly, many ultrafine particulates, such as color dyes or polymer-emulsion adhesives, are largely immune to flocculation by alum or organic polymers.

Another detrimental side effect of the slow and selective flocculation of heterodisperse and polydisperse furnish components in the acidic and alkaline papermaking processes of the prior art is the formation of aggregates of the undesirable segregated [. . . fiber/fiber. . . ] or [. . . filler/filler. . . ] types. The latter segregation, in turn, is the reason for a reduced retention of filler particles on the forming wire, deterioration of web-formation quality, and reduction of the optical-performance efficacy of filler particles retained in the web. The slow and selective flocculation is particularly detrimental to the optical-performance efficacy of the expensive titanium dioxide ($TiO_2$) pigments, which are virtually always employed in combination with less expensive, low-refractive-index extender pigments intended to function as physical spacers. The reason for this reduced optical-performance efficacy of $TiO_2$ is that, because of the inefficient (slow and selective) flocculation processes of the prior art, the predominantly formed filler-particle aggregates are of the optically inferior [. . . $TiO_2/TiO_2$. . . ] and [. . . extender/extender. . . ] types instead of the desirable, optically far more efficient [. . . extender/$TiO_2$/extender. . . ] type.

It should also be borne in mind that a substantial proportion of furnish ingredients dispensed from the headbox onto the forming wire is not retained in the first pass and must be recycled a couple of times through the papermaking process. Since the flocculation of furnish ingredients in the conventional (prior-art) acidic and alkaline papermaking processes is also incomplete, the detrimental effects of fractionation and selective aggregation (flocculation) of the individual furnish components are continuously amplified during the above-mentioned recycling.

The instantaneous, indiscriminate and complete flocculating action of the in-situ (in the furnish) synthesized complex functional microgels used in practicing the present invention totally eliminates the drawbacks normally associated with the use of highly heterodisperse and polydisperse paper, board and wet-laid-nonwoven furnishes. Hence, novel and unusual types of paper, board and nonwoven products can be prepared from even the most exotic, extremely heterodisperse and polydisperse furnishes, without incurring even a trace of selectivity (fractionation) or incomplete flocculation. As is readily understood by those skilled in the art, furnishes of the above-mentioned type could not be used in the papermaking processes of the prior art without incurring unacceptable material losses and operational difficulties, not to mention potentially disastrous ecological consequences.

The exotic furnishes under discussion may contain, among other things, cellulosic fibers; synthetic organic fibers; inorganic fibers; reinforcing synthetic microfibrils and extraneously prepared cellulosic microfibrils; magnetic and electroconductive metal powders; mineral as well as plastic filler pigments with particle dimensions ranging from about 0.1 μm up to 20 μm e.s.d.; non-film-forming (nonfusing, or fusing only at elevated temperatures) emulsion polymers with particles as small as 30 nm in diameter; novel ultrafine polymer-emulsion adhesives with particles smaller than 55 nm in diameter and glass-transition temperatures ranging between −60° C. and +20° C.; novel waterborne rubber cements; commercial water-soluble paper adhesives; microparticulate thermoplastic adhesives; color pigments; and carbon black with particles even smaller than 10 nm in diameter. Moreover, the above particulates may have relative densities ranging from about 1 g/cm$^3$ for organic polymers up to 4.2 g/cm$^3$ for titanium dioxide pigments, or yet considerably higher for metal powders, while their surface-chemical properties may range from very hydrophilic to extremely hydrophobic.

Virtually no limits to potential furnish diversities, hence also to the diversity and versatility of the resultant paper, board and wet-laid nonwoven products, are envisaged with the papermaking process of the present invention since, in the applicant's extensive investigations, no waterborne dispersion or colloidal system, regardless of how fine, complex or difficult, had yet been encountered able to resist the overpowering instantaneous, indiscriminate and complete flocculating action of the in-situ synthesized complex functional microgels under discussion.

The secondary purpose of the complex functional microgels is to provide, by virtue of their inherent cementing properties, an increased level of mechanical strength to paper, board and wet-laid nonwoven products made by the process of the present invention. The adhesive action of these microgels can be controlled by both the dosage employed and a purposeful optimization of their chemical composition, much in the same way as is customary in optimizing the bonding strength of contemporary industrial inorganic cements. With cellulosic webs, the principal mechanical strength is derived from hydrogen bonds formed between functional groups exposed at the surface of fibrillated (refined) cellulosic fibers, the acting range of such bonds extending merely over a distance of a few of Angstroms. A secondary reinforcement of cellulosic webs made by the prior-art papermaking processes is presently obtained with the aid of water-soluble polymers, mainly starch, added directly to the papermaking furnish.

While the concept of cementing synthetic organic and inorganic fibers by the complex functional microgels used in practicing the present invention is rather straightforward, an analogous cementing of cellulosic fibers is unique and warrants further elaboration. As is obvious from elementary chemical considerations, the in-situ (in the furnish) synthesized complex microgels of calcium-silico-aluminate or similar types leave, upon drying, an inorganic residue embedded in the resultant cellulosic-web structure. According to prior-art's teachings and experience, however, any and all inorganic particulates embedded between cellulosic fibers invariably inhibit the formation of close-range hydrogen bonds by physically separating the fibers, thus weakening the resultant webs.

To effectively "glue" cellulosic fibers to each other with the aid of the microgels in question, three obvious conditions must thus be met. First of all, the microgel particles must be extremely small (ultrafine), such as are indeed obtained with the aid of the high shearing forces used in synthesizing these microgels, in situ, in paper, board and wet-laid-nonwoven furnishes. Secondly, the ultrafine microgel particles must be "strategically" deposited at the very contact areas between adjacent fibers. Thirdly, the microgel particles must have an inherent deformability to spread in the form of discrete, ultrathin layers between the adjacent fibers to be cemented. Needless to say, only true microgel particles, but not solid aquasol particles or precipitates, such as pigments, are capable of such a deformation. Some quantitative aspects of the adhesive action of the complex microgel cements in cellulosic webs will be discussed in the context of the examples to follow.

An additional interfiber bonding of a hitherto unknown kind can be obtained by coflocculating, with the aid of the complex microgels, novel ultrafine polymer-emulsion adhesives added directly to the papermaking furnish. The subject matter of this novel class of adhesives, developed by the applicant specially for microadhesive applications, is disclosed in the co-pending patent application Ser. No. 07/958,283 ("Ultrafine Polymer-Emulsion Adhesives for Microadhesion"), filed Oct. 9, 1992, incorporated herein by reference. The latter adhesives, encompassing primarily acrylic polymers and copolymers, have average particle diameters smaller than 55 nm and glass-transition temperatures ($T_g$), ranging from −60° C. to +20° C. In comparison, the average particle diameters of even the finest conventional (commercially available) polymer-emulsion adhesives, known in the trade as "latexes," are significantly coarser, e.g., in excess of about 70 nm.

It should be pointed out in the above context that polymer-emulsion adhesives have found thus far no application as direct furnish additives in the prior-art acidic and alkaline papermaking process, since they cannot be acceptably flocculated (retained with furnish solids) by the latter. Moreover, even the finest conventional latexes, used as wet-end additives, are too coarse to provide any measurable interfiber bonding until the relative weight-content of latex in the web exceeds about 15%. As a consequence, commercial latexes are used only to saturate paper or wet-laid nonwoven webs that have already been preformed.

The interfiber bonding of cellulosic webs by the above-mentioned ultrafine polymer-emulsion adhesives represents a fundamentally new discovery, which, for all practical purposes, applies exclusively to the papermaking process of the present invention but not to the acidic or alkaline papermaking processes of the prior art. It should be pointed out, however, that the interfiber bonding in question is observed only when the above-mentioned ultrafine polymer-emulsion adhesives have average particle diameters smaller than 55 nm and their content in cellulosic webs does not exceed 2% of the webs' mass (the interfiber-bonding action of the latter adhesives stops increasing perceptibly beyond the 2% level until substantially higher adhesive contents in the web, on the order of about 10–20%, are reached).

The ternary function of the in-situ synthesized complex functional microgels is to impart desirable functional characteristics to the resultant paper, board and wet-laid nonwoven products, important from the standpoint of the latters' end use applications. These functional characteristics are derived from the microgels, own highly diversified physical and surface-chemical properties, which can be controlled to a large extent by a purposeful modification of the microgels' chemical composition to suit the intended end-use applications of the resultant paper or wet-laid nonwoven products. For example, intrinsically sized paper can be manufactured in accordance with the present invention by incorporating minor proportions of organic, cationically active chemical compounds with at least two reactive groups in each molecule into the solutions of bivalent and multivalent inorganic cross-linking salts. The resultant complex microgels, made up of hybrid macromolecules of an inorganic/organic polymer-polycondensate type, are interspersed throughout the consolidated cellulosic webs in a statistically uniform fashion, providing a steric matrix of discrete hydrophobic sites, thus also a controlled level of intrinsic sizing.

The surface-chemical properties of the resultant webs can also be modified indirectly with the aid of the complex functional microgels under discussion, by coflocculating with other furnish ingredients such powerful surface-chemistry-modifying agents in their own right as polymer-emulsion adhesives (having a dual organophilic/hydrophilic character), organophilic or even hydrophobic organic dyes, polar mineral pigments, or organic polymers of controlled polarity.

The principal reagents of commercial significance for the synthesis of the complex (multicomponent) functional microgels used in practicing the present invention are as follows:

(1) alkali-metal silicates and quaternary ammonium silicates, preferably sodium or potassium silicates;
(2) alkali-metal aluminates, alkali-metal zincates and blends thereof in any proportions, preferably sodium or potassium aluminates and/or sodium or potassium zincates; and
(3) water-soluble, essentially colorless, bivalent and multivalent salts of calcium, magnesium, barium, aluminum, zinc, and zirconium, preferably calcium chloride or calcium nitrate. The use of calcium nitrate, alone or in blends with calcium chloride, is beneficial during hot seasons when many paper mills encounter problems of aggravated bacterial contamination and slime growth.

The pH of microgel-flocculated paper, board and wet-laid-nonwoven furnishes usually ranges from about 8 to 12, depending to a large extent on the initial acidity of the process water employed. The use of aluminum sulfate, alone or in a combination with calcium chloride and/or other equivalent cross-linking salts, may be advantageous in those instances in which it is desirable to lower the pH of a flocculated paper furnish, particularly one containing groundwood fibers. In addition to, or instead of aluminum sulfate, sulfuric acid and other common acidifying agents can also be used for the above purpose. The proportions of acidifying agents needed to lower the furnish pH to a desired level must be assessed beforehand, e.g., by flocculating an aliquot sample of the furnish with an unadulterated (alkaline) complex microgel and then titrating the resultant flocculated furnish with a solution of the acidifying agent(s) to be employed.

Since the primary functions of the complex functional microgels used in practicing the present invention are limited to flocculation, cementation, and surface-chemical modification of particulate ingredients of paper, board and wet-laid-nonwoven furnishes, these microgels are used as a rule only in proportions necessary to accomplish the intended tasks. In general, a microgel content ranging from about 0.4% to 10%, by weight, as determined by ashing, was found to be adequate for many types of paper, board and wet-laid nonwoven products. The preferred microgel contents for most commercial paper, board and wet-laid nonwoven products range from about 4% to 10%, by weight, as determined by ashing after washing out the electrolyte by-products of the cross-linking reaction, such as NaCl, $NaNO_3$, or $Na_3SO_4$.

In the majority of laboratory and pilot-plant trials carried out with papermaking furnishes comprising cellulosic fibers, conventional inorganic fillers, and/or novel aggregate filler pigments (to be dealt with in more detail hereinafter), two different dosages of the microgel-forming reagents were employed. With furnishes having a solids content in excess of 5%, by weight, the reagent dosages encompassed 2 g of sodium silicate, 2 g of sodium aluminate, and 4 g of calcium chloride per 100 g of dry furnish mass. With furnishes having a solids content of less than 5%, the reagent dosages encompassed 3 g of sodium silicate, 3 g of sodium aluminate and 6 g of calcium chloride per 100 g of dry furnish mass. From the standpoint of both lowering the reagent-consumption requirements and attaining better end results, it is advantageous to use the highest possible furnish-solids concentrations, e.g., of up to 20% or even 30%, by weight. Furnishes with a solids concentration appreciably lower than 2%, by weight, may require higher microgel dosages than those recommended above.

There is a great latitude with regard to the quantitative and qualitative composition of both the (intermediate) transient, chemically reactive subcolloidal sodium-silico-aluminate or similar hydrosols, on the one hand, and the (final) complex microgels, used in practicing the present invention, on the other, without detriment to their intended functions. For example, the acceptable ratio of sodium silicate to sodium aluminate, sodium silicate to sodium zincate, or sodium silicate to the combined mass of sodium aluminate and sodium zincate employed in forming the above subcolloidal hydrosols can be varied from by weight. As had been established in numerous trials pertaining to the manufacture of paper, board and wet-laid nonwoven products, a preferred such ratio is 1:1.

The preferred concentration of sodium silicate in the furnish ranges from 0.01% to 2.0%, by weight, the same range of concentrations being preferred with sodium aluminate, sodium zincate or combinations thereof. When concentrations of the above reagents in the furnish exceed 2%, by weight, an accelerated molecular-weight growth of sodium-silico-aluminate (zincate) macromolecules sets in, reducing the latters' chemical reactivity toward the inorganic cross-linking salts. To sustain a sufficient level of chemical reactivity necessary for synthesizing complex functional microgels with adequate flocculating and cementing properties, the transient subcolloidal hydrosols evolving from such concentrated reagent solutions should be cross-linked within a period of a few seconds, which, in turn, necessitates the use of special, extra-efficient in-line mixers/-reactors.

The ratio of calcium chloride or equivalent inorganic cross-linking salt(s) to the combined mass of the transient, chemically reactive subcolloidal hydrosols to be cross-linked can vary from 1:10 to 10:1, by weight, but the simple ratio of 1 was found to be most satisfactory for synthesizing in situ complex functional microgels with adequate flocculating efficacies and for providing a subsequent marked enhancement of the dry and wet strength of the resultant webs. While the inorganic cross-linking salts can be used in proportions ranging from 0.4% to 10%, by weight, of furnish solids, the amount of calcium or equivalent bivalent and multivalent ions present in the reaction medium should optimally exceed by at least 50% the quantity of such ions bound chemically by the above-mentioned transient subcolloidal hydrosols. As was determined by a chemical analysis of filtrates from complex microgels synthesized in plain water, the above-mentioned excess of cross-linking ions reduces the residual concentration of unreacted silicate and aluminate (zincate) molecules to just a few parts per million. For most practical purposes, it is adequate to employ the bivalent (multivalent) inorganic cross-linking salts at a concentration of from 0.02% to 4.0%, by weight, in the paper, board and wet-laid-nonwoven furnishes.

Although many organic, cationically active chemical compounds with at least two reactive groups in each molecule are themselves capable of cross-linking the transient, chemically reactive subcolloidal sodium-silico-aluminate and similar hydrosols, their use as the sole cross-linking agents is not recommended for most practical purposes. Instead, the latter organic compounds, selected from the group comprising cationic surfactants, organometallic Werner complexes and cationic polyelectrolytes, should be added in only relatively minor proportions to the solutions of inorganic cross-linking salts to the extent needed for imparting the desired surface-chemical modification to the in-situ synthesized complex microgels, thus indirectly also to the resultant paper, board and wet-laid nonwoven products. It is important, however, to monitor the cementing efficacy of the evolving hybrid inorganic/organic microgels, in that the former deteriorates perceptibly with the increasing levels of organic cationic compounds built into the macromolecules making up the microgels in question.

The quantitative levels of the organic, cationically active cross-linking agents with at least two reactive groups in each molecule, necessary for a particular functional purpose, e.g., surface-chemical modification of paper, board or wet-laid nonwoven webs, must be determined empirically for each individual agent and the intended end-product application, e.g., with the aid of contact angle determinations, sizing tests, and so forth. According to the present findings, a pronounced modification of surface-chemical properties of fibrous products made with the aid of complex microgels of an inorganic/organic type was observed when the organic cross-linking agents were present in paper, board or wet-laid non-woven furnishes at concentrations of from 0.0003% to 0.15%, by weight. The practically useful proportions of these agents in the resultant cellulosic or wet-laid nonwoven webs range from about 0.001% to 0.5%, by weight.

It should be emphasized that the formation of both the (intermediate) transient, chemically reactive subcolloidal sodium-silico-aluminate or similar hydrosols and the (final) complex functional microgel cements used in practicing the present invention are not stoichiometric. Identical transient subcolloidal hydrosols and final complex microgel cements are synthesized each time, however, when the same compositions, concentrations, proportions, dosages, rates and sequences of addition of the reagents, as well as the specified reaction conditions, are maintained during the synthesis process.

As is typical of ultrafast chemical reactions in aqueous media, the in-situ formation of complex functional microgels used in practicing the present invention is practically independent of the temperature of the reaction medium. In principle, therefore, the above microgels can be formed within the entire temperature interval in which water remains fluid, provided that the stability of the reagents is not affected at elevated reaction temperatures. A special consideration, for example, should be given to the limited thermal stability of solutions of sodium aluminate.

The above virtual independence of the synthesis process from thermal conditions and regimes is a unique feature of the above complex microgels, which becomes readily apparent when comparisons are made with the methods of preparation of even much simpler single-component or bicomponent colloidal systems, such as silica and alumino-silicate gels or aquasols (colloidal suspensions of solid particles) known in the prior art. For example, numerous patents disclosing various methods of manufacturing pharmaceutical preparations, ion exchangers, catalysts and other products based on extraneously or in-situ prepared gels, aquasols or precipitates, sometimes of an identical chemical composition, often differ merely with respect to some seemingly minor (though critical to these products' successful synthesis) variations in the thermal regimes.

The broad latitudes with regard to concentrations and chemical compositions of the reagents, or to reaction conditions tolerable in synthesizing the complex functional microgels under discussion, are indicative of the enormous potency of the general colloid-chemical system used in practicing the present invention. It is worth noting that similar latitudes are virtually unheard-of with analogous processes of the prior art, according to which even most simple monocomponent and bicomponent colloidal systems based on silica or alumino-silicates must always be synthesized under rigorously maintained procedural and thermal regimes as well as strictly defined concentrations, proportions and types of reagents and pH conditions in the reaction medium.

A still more detailed discussion of the subject matter of the above complex functional microgels is provided in the specification to the previously mentioned co-pending patent application Ser. No. 07/919,831 ("Functional Complex Microgels with Rapid Formation Kinetics"), filed Jul. 27, 1992.

The alkaline version of the papermaking process of the present invention is illustrated in the example to follow.

EXAMPLE I

A set of handsheets was prepared by treating a chemical pulp consisting of a 50:50 softwood/hardwood blend with a brightness of 86%, using the previously described in-situ (in the furnish) synthesized calcium-silico-aluminate microgels as the papermaking (wet-end) chemicals. The handsheets, having dimensions of 20 cm×20 cm and a basis weight of 60 g/m$^2$, were prepared with the aid of a sheet mold, using a procedure developed specifically for laboratory applications of the papermaking process of the present invention.

According to the latter procedure, a "minibatch" of pulp with a consistency of 3%, in an amount sufficient for the preparation of just a single handsheet, was introduced into a Waring blender with a capacity of 500 cm$^3$. Aqueous 5%-solids solutions of sodium silicate and sodium aluminate were injected simultaneously into the strongly agitated furnish using plastic syringes positioned at diametrically opposite sides of the blender, avoiding a direct contact between the ejecting streams of reagent solutions. After about 20 seconds, the 5%-solids aqueous solution of calcium chloride was injected into the same strongly agitated furnish. The proportions of active reagents used per 100 g of pulp were 3 g of sodium silicate, 3 g of sodium aluminate and 6 g of calcium chloride.

The minibatch of flocculated furnish was transferred from the blender into a 2-liter beaker and, after an aging period ranging from a few minutes to about 2 hours, diluted with water (under stirring) to the full capacity of the beaker and poured into the mold to form a handsheet. The wet handsheets were first pressed to a solids level of about 35% and then dried on a rotating heated drum covered with a felt. The relative weight content of mineral residue (discrete calcium-silico-aluminate microgel deposits) retained in the handsheets, further called the "principal handsheets," was equal to about 7%, as determined with the aid of standard gravimetric methods.

Analogous handsheets, further called "control handsheets," were prepared with the aid of a typical acidic papermaking process using alum and Percol 292 (a high-molecular-weight cationic polyacrylamide flocculant) in proportions of 20 lbs. and 1 lb., respectively, per ton of pulp. Some of the control handsheets were prepared from a furnish containing only fibers while some additional control handsheets were prepared from the same furnish to which increasing proportions of starch were being added.

The principal handsheets were characterized by a vastly better formation quality, significantly higher dry and wet strengths as well as stiffness, more pronounced "rattle" and slightly higher brightness and opacity than analogous control handsheets made without the use of web-strength-reinforcing starch. Since a legitimate comparative assessment of the optical properties of paper products requires that the systems under evaluation always be of equal mechanical strength, the principal handsheets were additionally evaluated against appropriately matched, starch-reinforced control handsheets. Since wet-end starch markedly reduces handsheets' brightness and opacity, the principal handsheets (devoid of starch) were, in the final balance, both brighter and more opaque by about 1.5 to 2 percentage points than the corresponding starch-containing control handsheets of equal mechanical strength.

It is important to point out that the rather substantial content (i.e., about 7%, by weight) of the microgel residue in the principal handsheets only slightly increased the latters' brightness and opacity, which is clearly indicative of the extremely small dimensions of microgel particles (deposits) retained in the sheets. In general, the undersized pigment fractions with particles smaller than about 0.1 μm e.s.d. are referred to in the trade as ultrafine, or subpigmentary, since their inadequate light-scattering efficacy disqualifies them as pigments in the conventional (commercial) sense. The discrete microgel residues embedded in the handsheets, however, are dimensionally yet much smaller than typical subpigmentary particles. As is well known to those skilled in the art, the principal handsheets would be automatically brighter by about 3–4 percentage points and more opaque by about 8–10 percentage points if the microgel residue in the sheets were replaced with an equivalent proportion (i.e., 7%, by weight) of an extraneous synthetic filler pigment, such as precipitated calcium silicate or an in-situ (in the furnish) precipitated alumino-silicate filler pigment of the type disclosed in Pacquin U.S. Pat. No. 2,757,085.

It is worth pointing out that results identical to those reported above were also obtained when sodium aluminate, as the constituent of the transient subcolloidal hydrosols, was partially or totally replaced with sodium zincate, or when calcium chloride, as the cross-linking agent, was partially or totally replaced with calcium nitrate.

In analyzing the findings discussed in the above example, the foremost emphasis should be placed on the unique sheet-strength-reinforcing action of the in-situ-synthesized complex microgels used in practicing the present invention. Numerous other beneficial and unique properties of the complex microgels notwithstanding, the hitherto unheard-of reinforcement of sheet strength by embedded inorganic particles unmistakably distinguishes the above microgels from all seemingly related inorganic colloid-chemical systems known in the prior art.

Another important finding made in evaluating paper samples prepared in Example I was the enormous magnitude of "wet strength" imparted to the principal handsheets by the calcium-silico-aluminate microgels. The above performance property common to the complex microgels under discussion is particularly attractive from a commercial standpoint in that the practical means for increasing the wet strength of paper, known in the prior art, are quite limited. Hence, the wet strength of handsheets dried according to the procedure described in Example I was found to be about 100% higher with the principal sample than with analogous control samples. However, after an additional heating for 30 seconds at a temperature of 204° C. (400° F.), the wet strength of handsheets was found to be 600% higher with the principal sample than with the corresponding control samples.

The above spectacular wet-strength increase of microgel-containing handsheets can be explained, in principle, by the fact that calcium-silico-aluminate microgels become essentially fully cured, thus also water resistant, when heated at a temperature of about 218° C. As is readily understood, the high-wet-strength properties can be imparted to cellulosic webs by the in-situ synthesized complex microgels only because the discrete microgel deposits, interspersed throughout the fibrous structure, are both ultrathin, causing no interference with the formation of close-range hydrogen bonds between cellulosic fibers, and strategically located at the intimate fiber-to-fiber contact areas. In comparison, the only practically feasible ways of increasing the dry or wet strength of cellulosic webs known in the prior art are through the addition of organic water-soluble "glues" to the fiber furnish.

An outstanding feature of the papermaking process of the present invention, inherently related to the instantaneous, indiscriminate and complete flocculation mechanism, is that all particulate furnish ingredients become coflocculated in a statistically most uniform fashion, regardless of these particulates' dimensions, morphology, relative densities, surface chemistry or colloidal characteristics. As a consequence, the detrimental fractionation, segregation and selective aggregation (flocculation) of particulate ingredients contained in heterodisperse and polydisperse papermaking furnishes, such as cannot be avoided in the papermaking processes of the prior art, is, for all practical purposes, totally eliminated in the papermaking process of the present invention.

Some of the instant as well as potential benefits derived from the flocculation mechanism inherent to the papermaking process of the present invention become apparent by way of the following example:

EXAMPLE II

Three laboratory batches of identical furnish, each containing 80%, by weight, of a 50:50 hardwood/softwood blend and 20%, by weight, of a delaminated clay filler, were prepared at an initial consistency of 3%, by weight.

The main batch, designated as the "principal" batch, was flocculated with the aid of the in-situ synthesized calcium-silico-aluminate microgels according to the procedure described in Example I and then diluted to a consistency of 0.7% typically used in commercial paper machine operations. The first control batch, designated "AC" (acidic), was diluted right away to a consistency of 0.7% and then flocculated in accordance with typical prior-art acidic-papermaking procedures, using alum and Percol 292 in proportions of 20 lbs. and 1 lb., respectively, per ton of furnish solids. Similarly, the second control batch, designated "ALK" (alkaline), was diluted to a consistency of 0.7% and then flocculated in accordance with typical prior-art alkaline papermaking procedures using a pair of organic polymeric retention aids (Calgon Polymer H-7392 and Calgon Polymer H-7736 EZ), each in a proportion of 2 lbs. per ton of furnish solids. The pH of the furnish was adjusted to a level of 8 using sodium hydroxide.

Each of the above flocculated furnish samples was transferred into separate sealed glass jars for further observation. Both control batches, "AC" and "ALK," were characterized by decidedly nonuniform, coarsely grained floc structures, the carrier medium (water) being permanently cloudy with a substantial proportion of solid matter settling rather promptly to the bottom of each jar. Unlike both control batches, the principal batch settled to the bottom of the jar in the form of a single floc ("monofloc") resembling a large, fluffy cotton ball surrounded by a crystal-clear supernatant, the monofloc in question being characterized by an extremely uniform micrograin structure.

After some period of aging, each of the above-mentioned jars was rapidly inverted. Both of the jars containing the control batches revealed a layer of a densified tacky residue, consisting predominantly of filler particles firmly adhering to the bottom of the jar. The above separation of furnish ingredients, of course, provides clear evidence that the flocculation mechanisms inherent to the acidic and alkaline papermaking processes of the prior art are slow, selective, and incomplete, leading to a predominant formation of aggregates of the undesirable segregated [. . . filler/filler. . . ] and [. . . fiber/fiber. . . ] types, instead of the desirable heteroaggregates of a [. . . fiber/filler. . . ] type. In contrast, the bottom of the inverted jar containing the principal batch was completely clear, indicative of the fact that the entire filler content of the furnish was firmly and intimately coflocculated with the cellulosic fibers.

As is readily understood by those skilled in the art, the potential practical consequences of the above findings are enormous. In accordance with the prior art, for example, paper and board are made from very dilute furnishes, containing only about 0.5–0.7%, by weight, of solid matter. The latter cumbersome dilution requiring vast amounts of water is indispensable in that the web-formation quality deteriorates rapidly as the solids concentration in the furnish is increased. In contrast, the inherent, extremely uniform micrograin structure of furnishes flocculated with the aid of the in-situ-synthesized complex microgels makes it possible to use furnishes with significantly higher solids concentrations than are feasible in the papermaking processes of the prior art without detriment to the resultant web-formation quality. According to present indications, solids concentrations in the furnish (furnish consistencies) could be increased 2 or 3 times above the customary levels with only minor modifications of the contemporary headbox designs. Yet higher furnish consistencies, e.g., of up to 4 or 5 times higher than those currently used, are likely to be feasible with somewhat more radically modified headbox designs.

The inescapable deterioration of web-formation quality resulting from attempts to increase paper machine speeds beyond the current practical limits is also well known to those skilled in the art. Again, due to the extremely uniform intrinsic micrograin structure of fiber/fiber flocs (in fillerless furnishes) and fiber/filler flocs (in filler-containing furnishes) generated by the action of the in-situ-synthesized complex microgels, it is now possible to greatly increase the paper machine speeds without detriment to the resultant web-formation quality. It is also possible to combine increased furnish consistencies with higher paper machine speeds to manufacture well-formed paper, board and wet-laid nonwoven webs using the papermaking process of the present invention.

The total coflocculation of cellulosic fibers and mineral filler particles by the in-situ synthesized complex microgels is another important finding made in Example II. As is well known to those skilled in the art, the uniformity of web formation in the acidic and alkaline papermaking processes of the prior art improves with increasing filler-loading levels, up to about 20%, by weight. As the filler-loading levels are still further increased, however, the papermaking furnishes must be excessively flocculated to obtain an adequate first-pass retention of pigment particles in the web, the unavoidable consequence of this "overflocculation" often being manifested in an excessive deterioration of the web-formation quality. In a radical contrast, the intrinsic micrograin structure of high-ash furnishes flocculated with the in-situ synthesized complex microgels under discussion, as well as the quality of formation of the resultant webs, steadily improves with the increasing filler-loading level, even if the latter exceeds 50%, by weight. As shall be discussed in more detail hereinafter, the latter repeatedly verified finding now makes possible to manufacture very-high-ash paper products with a web-formation quality not attainable hitherto with the aid of the papermaking processes of the prior art.

As is also well known to those skilled in the art, significant proportions of valuable furnish ingredients are systematically and irretrievably passed into waste-water streams when the acidic or alkaline papermaking processes of the prior art are employed, causing substantial material losses as well as serious ecological problems. On the other hand, the total (100% complete) flocculation of particulate furnish ingredients attained with the aid of the papermaking process of the present invention enables one to recover 100% of the particulate matter from spent furnishes before the latter are passed to waste-water streams. The complete elimination of particulate contaminants from waste-water streams, using filtration, cycloning and other easy methods for separating solids from liquids, provides a clear economical and ecological advantage over the papermaking processes of the prior art.

The total coflocculation of fibers and filler particles by the in-situ-synthesized complex functional microgels offers the attractive possibility of attaining a true "self-extinguishing" process loop on a paper machine. Such a self-extinguishing loop can be realized preferably by replacing the conventional water-soluble starch adhesives in papermaking furnishes with particulate (polymer-emulsion) adhesives and flocculating these furnishes at very-high solids, e.g., of up to 10–30%, by weight, with the aid of the in-situ synthesized complex functional microgels. By purging the resultant systems of salt byproducts of microgel formation and other solute contaminants, e.g., by using a vacuum filtration combined with spray rinsing, essentially solute-free and electrolyte-free papermaking furnishes can be obtained. The above contaminant-free furnishes, diluted subsequently with water to a desirable headbox consistency, can be recirculated on a paper machine until their solids are totally depleted, the portion of furnish solids retained on the forming wire being continuously replenished with a new portion of a (virgin) purified furnish. Thus, the customary heavily polluted waste-water streams from paper machines can be eliminated completely, with enormous quantities of water being saved as an additional benefit. The sole waste stream resulting from such a closed-loop papermaking process is a low-volume, relatively concentrated crystal-clear filtrate containing sodium and calcium salts, dispersants (e.g., from fillers and adhesives) and similar solutes extracted from the flocculated high-consistency papermaking furnishes before using them on a paper machine.

It should be emphasized that the customary laboratory procedures for making handsheets, which rely on furnishes that are 25–50 times less concentrated than analogous furnishes used on paper machines, do not always provide a correct indication of the filler-retention efficiencies to be obtained in commercial operations. For example, slightly lower filler-retention efficiencies were sometimes observed when laboratory handsheets were prepared from such highly dilute furnishes with the aid of the papermaking process of the present invention, using all-inorganic (calcium-silico-aluminate) microgels, than were obtained when similar handsheets were prepared with the aid of the acidic and alkaline processes of the prior art. However, when analogous large-scale papermaking trials were carried out with the aid of a pilot-plant paper machine, using typical commercial furnish-solids concentrations of 0.5–0.7%, by weight, the resultant filler retention efficiencies were consistently higher with the papermaking process of the present invention than with the acidic and alkaline papermaking processes of the prior art.

The reason for the above-mentioned reversal of filler-retention trends (from preliminary laboratory indications to the actual full-scale results on a paper machine) is a better utilization of the fiber fines generated during refining of cellulosic pulps. The discrete cellulosic fiber fines generated by refining are "short-lived," reattaching themselves readily to the comparatively much larger full-fledged fibers after a relatively short period of aging, or, particularly, during the course of furnish flocculation by the slow and inefficient flocculation mechanisms of the acidic and alkaline papermaking processes of the prior art. As a consequence, the latter fiber fines contribute little or nothing to reinforcing the resultant fibrous networks or to facilitating the retention of filler particles. However, when freshly refined fiber furnishes (still containing freely floating, unattached fiber fines) are treated with the in-situ synthesized complex microgels inducing an instantaneous flocculation of all particulates present in the furnish, the numerically abundant fiber fines become intricately coflocculated with full-fledged fibers, significantly contributing to the reinforcement of the resultant fibrous networks.

Most of all, however, the unattached fiber fines coflocculate predominantly, in accordance with the laws of statistics, with the numerically yet more abundant filler particles present in the furnish. The filler-laden fiber fines are obviously heavy in relation to their geometrical dimensions and have a low buoyancy. Hence, bearing in mind that the principal mechanism of filler-particle retention on the forming wire is filtration (a fibrous mat is first formed on the forming wire, which then "filters out" the flocculated filler particles), it is readily understood that filler-laden fiber fines are difficult to retain on the forming screen when making laboratory handsheets from highly dilute furnishes. On the other hand, the fact that filler-laden fibers fines are efficiently retained on a paper machine when typical commercial furnishes with a solids content of 0.5–0.7% are being employed clearly points to an additional, hitherto unknown filler-retention mechanism based on the "entanglement" of filler-laden fiber fines with consolidating fibrous networks.

As was established in numerous trials, extremely high filler-retention efficiencies, unmatched by those typical of the prior-art acidic and alkaline papermaking processes, were consistently obtained, regardless of whether the furnishes were dilute or concentrated, when relatively minor proportions of organic cationic polyelectrolytes were added beforehand to the solutions of inorganic cross-linking salts. For example, by incorporating Percol 292 or Hydraid 777 in proportions of from 0.5 to 0.75 lbs. per ton of furnish solids directly into the solution of cross-linking salt (calcium chloride), the resulting filler-retention efficiencies were increased by several percentage points relative to those obtained under similar conditions with the acidic and alkaline papermaking processes of the prior art. It is worth noting, though, that the above-mentioned or similar polymeric agents are customarily employed in the conventional paper-making processes in much higher proportions, usually ranging from about 2 lbs. to 4 lbs. per ton of furnish solids. Moreover, the formation quality of sheets obtained with the aid of the above-mentioned hybrid inorganic/organic complex functional microgels was invariably vastly superior to even the best commercial standards known to the applicant.

One of the most important tasks facing the paper industry at the present time is to develop new lines of high-quality printing papers in which a major portion of cellulosic fibers is replaced with mineral fillers. Paper products of the latter type, e.g., those having a relative filler content in excess of 25%, by weight, are referred to in the trade as "high-ash" papers. Regardless of the obvious ecological and economical benefits offered by high-ash paper products, however, tangible technological advances in implementing routine mass production of the latter are still in the state of relative infancy. The most important reasons for the above apparent lack of success are the excessive deterioration of sheet strength at high levels of filler loading, relatively high abrasivity of the conventional filler pigments, as well as the deterioration of sheet-formation quality associated with the harsh colloid-chemical measures which must be undertaken to effectively flocculate, retain and affix the massive proportions of fillers contained in high-ash papers. These harsh measures pertain, most of all, to employing high dosages of polymeric flocculants to obtain an adequate flocculation of filler particles in high-ash furnishes along with employing high proportions of water-soluble adhesives to compensate for the excessive fiber debonding resulting from high filler-loading levels. As is well known to those skilled in the art, the increased levels of flocculants and adhesives required in connection with high-ash furnishes complicate the delicate balances of wet-end chemistries of the acidic and alkaline papermaking processes of the prior art to a point exceeding the limits of these processes, objective performance capabilities. As the consequence, the web-formation quality of high-ash paper products as well as the optical-performance efficacy of both the filler pigments and cellulosic fibers is adversely affected.

Bearing in mind that the potential, as well as the inherent limitations, of the prior-art acidic and alkaline papermaking processes have already been thoroughly explored, it is highly unlikely that the vast array of difficulties associated with the manufacture of high-ash paper will be resolved in the foreseeable future with the aid of materials and technologies known in the prior art.

Novel promising approaches applicable to the manufacture of high-ash paper products have been opened, however, by the papermaking process of the present invention. One such approach is applicable to the manufacture of moderately-high-ash paper, containing up to 25%, by weight, of conventional mineral filler pigments in combination with the novel ultrafine polymer-emulsion adhesives discussed previously. Interspersed uniformly among the flocculated furnish ingredients, the ultrafine polymer particles form, upon drying and hot calendering of the resultant filled webs, microadhesive joints between individual filler particles as well as between individual filler particles or filler aggregates, on the one hand, and cellulosic fibers, on the other. It was indeed possible to make filled paper of satisfactory mechanical strength containing up to 25%, by weight, delaminated clay and 1–2%, by weight, novel ultrafine polymer-emulsion adhesives using the papermaking process of the present invention.

The papermaking process of the present invention is also suitable for manufacturing very-high-ash paper with filler-loading levels ranging from 25% to more than 50%, by weight. The manufacture of the above paper grades requires, however, that both the previously mentioned novel functional filler pigments and ultrafine polymer-emulsion adhesives be simultaneously employed. For filler-loading levels approaching or exceeding 50%, by weight, synthetic microfibrils and/or novel cellulosic microfibrils (to be discussed in more detail hereinafter) should also be employed in the papermaking furnish.

The subject matter of the above novel aggregate filler pigments is disclosed in detail by Kaliski in U.S. patent application Ser. No. 07/811,623 (Low-Refractive-Index Aggregate Pigment Products), filed Dec. 23, 1991 and in U.S. Pat. No. 5,116,418 ("Process for Making Structural Aggregate Pigments"), incorporated herein by reference. The filler pigments in question are made in principle by a controlled aggregation of very-fine-particle-size kaolin clays (often referred to in the trade as high-glossing clays) combined with other functional ingredients, such as the novel ultrafine polymer-emulsion adhesives, for reducing fiber debonding in paper-filling applications, and/or with synthetic and/or cellulosic microfibrils, for reducing fiber debonding and increasing filler-retention efficiency. The latter filler pigments are uniquely qualified for very-high-ash filling applications in that, among other things, these pigments' optical-performance efficacy does not decay at even the highest filler-loading levels and their unusually low abrasivity rarely approaches 0.5 mg on the Einlehner tester.

The unique suitability of the novel ultrafine polymer-emulsion adhesives for the manufacture of high-ash papers can be understood readily considering that their average particle diameters are smaller than 55 nm. In contrast, the average particle diameters of the overwhelming majority of polymer-emulsion adhesives (latexes) used in the paper industry range from about 150 to 200 nm. Hence, at any given adhesive mass, at least 60 times more microadhesive joints (involving single adhesive particles) can potentially be formed with the novel ultrafine polymer-emulsion adhesives than with conventional latexes. Moreover, as is well known in the art, the dimensions of the "glue line" (adhesive between two adhints) should be considerably smaller than the dimensions of the adhints themselves, particles of conventional latexes being as a rule too large to form proper microadhesive joints of fiber/filler or filler/filler types. As was found in numerous trials, a significant and steady web-strength increase of paper and wet-laid nonwoven products was obtained by increasing the dosage of the novel ultrafine polymer-emulsion adhesives up to 2%, by weight, of the web mass, whereas no corresponding web-strength increase was observed with conventional latexes.

It is worth pointing out in the above context that both conventional latexes as well as the novel ultrafine polymer-emulsion adhesives are for all practical purposes unsuitable as wet-end additives in the acidic and alkaline papermaking processes of the prior art. Since the inefficient flocculation mechanisms at the foundation of prior-art papermaking processes are incapable of totally flocculating polymer-emulsion adhesives of any kind, using the latter as wet-end additives would result in many serious runnability problems such as plugging of paper machine felts, surface picking of paper during calendering or printing, and contamination of wastewater streams. In contrast, both commercial latexes and the novel ultrafine polymer-emulsion adhesives are totally (100%) flocculated by the in-situ-synthesized complex functional microgels used in practicing the present invention, the use of such adhesives as wet-end additives presenting none of the above-mentioned runnability problems.

The manufacture of very-high-ash, ultraopaque color-coded paper for two-sided, high-resolution computer printout or office reproduction, using paper furnishes containing the previously mentioned aggregate (functional) filler pigments, organic color dyes and the novel ultrafine polymer-emulsion adhesives, shall be demonstrated in the example to follow. Ultraopaque printing paper is understood herein as having an opacity of at least 98.0%, necessary to eliminate the disturbing show-through of high-optical-density laser prints from the opposite sheet side.

To comprehend the enormous magnitude of practical difficulties in obtaining a conventionally machine-calendered sheet of paper with an opacity of 98% one should consider, for example, that a stack of three sheets of a typical white "xerox" paper used for office reproduction or computer printout, or a stack of two sheets of color-coded computer printout paper, will not always attain an opacity of 98%.

EXAMPLE III

The ultraopaque, color-coded handsheets under discussion were prepared using the procedures and fiber-furnish composition described in Example I, except that Hydraid 777 (a commercial polyelectrolyte retention aid) in a proportion of 0.75 lbs. per ton of furnish solids was added directly to the solution of calcium chloride used as the cross-linking salt.

In addition to cellulosic fibers, the furnish for making handsheets also contained the previously mentioned ultrafine polymer-emulsion adhesive in a proportion of 1.5 g per 100 g of furnish solids; a blue dye (Victoria blue) in a proportion of 0.075 g per 100 g of furnish solids (equivalent to 2 lbs. of dye per ton of furnish solids); and the previously mentioned aggregate filler pigment, used in such proportions as to obtain a filler-loading level of at least 35%, by weight, in the resultant handsheets.

All furnish components, including the polymer-emulsion adhesive and dye, were coflocculated uniformly and completely by the in-situ-synthesized hybrid inorganic/organic complex microgels, the supernatant (filtrate) being completely clear and colorless. The handsheets had a basis weight of 51.9 lbs. per 3000 $ft^2$; a filler-loading level of 35.0%, by weight; an opacity of 98.0%.; a brightness of 82.3%; and a lightness of 85.0%. The handsheets had satisfactory strength, handling and rattle, a very light pastel blue color, and a most attractive surface appearance resembling that of a coated paper.

The extra-high opacity of the above very-high-ash handsheets made it possible to print high-optical-density images on both sides, using a laser printer, without any print show-through from the opposite side being noticeable. Moreover, due to the high brightness and lightness, the handsheets were also found to be most suitable for desktop-publishing applications requiring high-resolution, high-fidelity, high-contrast reproduction of delicate halftone scales.

Similar very-high-ash handsheets as those described in the above example were also prepared using Hydraid 777, in a proportion equal to 1.5 lbs. per ton of furnish solids, by adding it by itself (as an aftertreatment) to furnishes that were already flocculated by an in-situ synthesized all-inorganic calcium-silico-aluminate microgel. Although the handsheets in question had the same filler content and optical performance as the handsheets from Example III, their sheet-formation quality was markedly poorer. The reason for the poorer sheet-formation quality was that the polymeric retention aid, added to an already flocculated furnish, induced a secondary, coarse flocculation pattern superimposed upon the original, very uniform microflocculation pattern. While the overall results, such as filler retention, optical performance or color uniformity of the above handsheets (made with Hydraid 777 used as an aftertreatment) were still better than can be obtained with analogous handsheets prepared with the aid of the acidic and alkaline papermaking processes of the prior art, the overwhelmingly preferred approach is using the papermaking process of the present invention in which the auxiliary organic retention aids are incorporated directly into the solutions of calcium chloride or equivalent cross-linking salts prior to the flocculation of the furnish.

The following example, pertaining to the preparation of filled groundwood handsheets, illustrates particularly clearly the benefits of adding the auxiliary organic polymeric retention aids directly to the solutions of the inorganic cross-linking salts used in practicing the present invention.

EXAMPLE IV

A sample of a typical groundwood furnish used for newsprint manufacture, additionally containing a typical low level of a mineral filler (mechanically delaminated clay), was aged for several hours to intentionally deteriorate the formation quality of the handsheets to be prepared from this furnish.

A set of newsprint handsheets, further called principal handsheets, was prepared with the aid of procedures outlined in Example I, except that Percol 292, used in a proportion of 0.5 lbs. per ton of furnish solids, was added directly to the solution of calcium chloride. Two similar sets of control handsheets were prepared from the same aged furnish using the acidic papermaking process outlined in Example I, Percol 292 being employed in a proportion of 1 lb. per ton of furnish solids in the first set of control handsheets and in a proportion of 2 lbs. per ton of furnish solids in the second set of control handsheets.

Despite of the intentional furnish aging, such as leads invariably to a deterioration of the web-formation quality of handsheets made by any prior-art papermaking process, the principal newsprint handsheets were characterized by a virtually perfect web-formation quality. As a matter of fact, a comparable web-formation quality is, to the best of the applicant's knowledge, impossible to attain with the aid of any laboratory or commercial newsprint-making processes of the prior art. In contrast, the web-formation quality of both sets of control newsprint handsheets was extremely poor, coarse unsightly flocs, undispersed clumps of fibers and other defects being clearly visible in the handsheet surface, and, viewed in a transmitted light, also in the handsheet interior.

As was anticipated, the brightness of the principal groundwood handsheets made under alkaline conditions (pH of about 9.5) was lower by about 3 percentage points than the brightness of control handsheets made by the prior-art acidic papermaking process. The above brightness reversal can be reduced, or even eliminated, by partially or totally replacing calcium chloride (as the cross-linking agent) with alum and/or adding a predetermined proportion of acid to the solution of the cross-linking agent(s).

From the standpoint of the overall results, however, it is still preferable to employ the alkaline version of the papermaking process of the present invention, combined with adding hydrogen peroxide directly into the newsprint furnish in proportions customarily employed in groundwood bleaching. By adding the hydrogen peroxide into the newsprint furnish prior to, or simultaneously with, the addition of the solutions of sodium silicate and sodium aluminate, the brightness reversal of groundwood fibers can be fully eliminated.

Some of the potential benefits of making newsprint under alkaline conditions are best evidenced by the fact that the brightness of the principal (alkaline) newsprint handsheets from Example IV remained unchanged even after a prolonged period of aging. In contrast, the originally brighter control newsprint handsheets, made by the acidic papermaking process, became progressively more yellow and brittle with increasing aging. It should be emphasized that while attempts have continuously been made worldwide to manufacture newsprint under alkaline conditions, tangible successes have thus far not been attained to the best of the applicant's knowledge.

Additional observations made in connection with the preceding example revealed that the filler-retention efficiency obtained with the control newsprint handsheets increased when the proportion of Percol 292 was increased from 1 to 2 lbs. per ton of furnish solids. The highest filler-retention efficiency was obtained, however, with the principal newsprint handsheets made from a furnish treated with the in-situ-synthesized hybrid inorganic/organic complex functional microgel, with Percol 292, in a proportion of 0.5 lb. per ton of furnish solids, added directly to the solution of calcium chloride.

Another important benefit derived from the instantaneous, indiscriminate and complete flocculation of all particulates present in paper, board and wet-laid-nonwoven furnishes is manifested in the formation of bulky, uniformly distributed steric configurations of filler-particle aggregates with a vastly enhanced light-scattering efficacy. As is well understood by those skilled in the art, it would be impossible to obtain an opacity of 98.0% with a 51.9 lbs./3000 $ft^2$ sheet from Example III, containing exclusively low-refractive-index fillers, if an abundance of such optically favorable aggregate-pigment configurations had not been formed within the web structure.

Still another important benefit of the papermaking process under discussion is a complete and extremely uniform coflocculation of organic dyes with the particulate ingredients of paper, board and wet-laid-nonwoven furnishes. The extraordinarily high level of opacity of handsheets obtained in Example III, of a magnitude hitherto impossible to attain with the aid of low-refractive-index fillers, is largely the result of an intrinsic interplay of light scattering and light absorption between the uniformly and intimately interspersed filler particles and dyes. It should also be emphasized that the entire dosage of the relatively low-color-intensity Victoria Blue dye used in Example III was equivalent to only 2 lbs. per ton of furnish solids. To obtain handsheets with a comparable level of color intensity with the aid of the acidic or alkaline papermaking processes of the prior art, the dye concentration in the furnish would have to be, as a rule, at least 10 times higher than in Example III due to the notoriously poor retention and unfavorable flocculation characteristic of virtually all organic dyes in both latter processes.

Intensely colored papers can also be obtained with the aid of the papermaking process of the present invention by simply increasing the proportions of dyes added to the furnish. Analogous intensely colored papers can not be made by the acidic or alkaline papermaking processes of the prior art without severe dye losses and the accompanying unavoidable serious contamination of waste-water streams. Moreover, the severe degradation of strength of intensely colored paper made by the papermaking processes of the prior art can be curtailed or even eliminated with the papermaking process of the present invention by incorporating the highly efficient novel ultrafine polymer-emulsion adhesives and/or novel waterborne rubber cements into the starting furnishes.

By far the most attractive colored papers are obtained, without exception, by combining the addition of dyes with high-ash filling. The surface of colored papers so obtained, particularly after supercalendering, has a unique, extremely pleasant silky appearance that is virtually impossible to duplicate by any other method known in the art. Moreover, the color uniformity of the resultant products is virtually perfect, resembling the uniformity of colored glass or ceramic tiles. In contrast, a more or less pronounced color unevenness and color two-sidedness typical of essentially all color papers made by the papermaking processes of the prior art can readily be detected by even casual evaluators.

The papermaking process of the present invention is also particularly well-suited for a complete coflocculation of carbon black with cellulosic fibers and filler particles present in a paper furnish. The need for carbon black in present-day papermaking becomes increasingly more acute in that very substantial opacity increments can be obtained most economically using extremely low dosages of this material. While it is necessary to forfeit some sheet brightness to gain an increment of the far more valuable and costly sheet opacity, the most favorable brightness-for-opacity trade off is obtained using carbon black dispersions prepared by the method disclosed in Kaliski U.S. Pat. No. 5,116,418 ("Process for Making Structural Aggregate Pigments"). The above method, referred to hereinafter and in the claims to follow as the "master-batch" method, makes it possible to vastly increase the opacifying power of prior-art commercial carbon-black dispersions. In accordance with the present industrial experience, the opacifying power of carbon black obtained from such dispersions is about 100–150 times higher than the opacifying power of titanium dioxide. An additional processing of the commercial carbon-black dispersions with the aid of the master-batch method in question still further increases the above-mentioned opacifying power by a factor of 20 to 50.

To sustain a total immobilization of carbon black in the resultant paper or wet-laid nonwoven products (a release of even traces of carbon black, e.g., on the order of parts per billion, would be unacceptable in the papermaking industry), the former must be employed in combination with latexes or ultrafine polymer-emulsion adhesives, or with novel waterborne rubber cements obtained by underpolymerization of the latter ultrafine emulsion adhesives. In contrast, as is well known to those skilled in the art, the prior-art papermaking processes are incapable of a complete flocculation and immobilization of either carbon black or polymer-emulsion adhesives.

The papermaking process of the present invention can also be used for the manufacture of very-high-ash printing papers with filler-loading levels approaching or even surpassing 50%, by weight, while considerably reducing these papers, basis weight and preserving the necessary sheet strength. The latter task can be realized by incorporating up to 2%, by weight, of synthetic microfibrils and/or extraneously prepared novel cellulosic microfibrils with a length ranging from about 10 μm to 200 μm in combination with 1–5%, by weight, of the novel ultrafine polymer-emulsion adhesives and/or waterborne rubber cements into furnishes for making the above-mentioned very-high-ash paper products.

The novel (extraneous) cellulosic microfibrils should be distinguished from ordinary fiber fines generated (in situ) during mechanical refining of cellulosic pulps, the latter fines being defined as miniature fibers passing through a 200-mesh screen. The extraneous cellulosic microfibrils, whose aspect ratio (the ratio of length to diameter) is 10 to 1000 times higher than that of fiber fines, can be obtained exclusively by the process referred to hereinafter as well as in the claims to follow as the "cascade-microfibrillation" process. According to the latter, cellulosic fibers derived preferably from cotton or well-fibrillating cellulosic pulps undergo the following consecutive processing steps:

(a) dry or wet chopping of fibers to a length preventing a hydraulic spinning during the subsequent wet refining, the resultant length being dependent upon both the furnish solids and type of refining equipment to be employed in subsequent processing;

(b) preliminary refining of chopped fibers resulting from step (a) at the highest practically feasible solids concentrations, e.g., of up to 30–35%, by weight, preferably in the presence of sodium silicate, Congo red and/or other inorganic and organic fibrillation-enhancing agents;

(c) additional refining of the fibers resulting from step (b) with the aid of centrifugal comminuters (exemplified by the well-known colloidal mills); and (d) finalizing of the fibrillation attained in step (c) with the aid of Gmolin homogenizers or equivalent equipment in which the fibrous furnish is compressed at very high pressures and then rapidly decompressed by passing through a nozzle, causing the residual bundles of fibrils to "explosively" separate into individual microfibrils.

The process of the present invention is also most suitable for the manufacture of advanced wet-laid nonwoven products on a paper machine. Contemporary nonwovens, as a class of materials, are manufactured in two consecutive processing steps. The first step involves preforming of unbounded fiber webs (mats) using either a wet-laid approach or the currently predominant dry-forming approach. Since the preformed webs, made up mainly of synthetic fibers, have no cohesive strength, suitable adhesives must be incorporated into the webs in the second processing step to establish adhesive joints between adjacent fibers.

The principal method of imparting the desired level of cohesive strength to the preformed webs is by saturating them with acrylic latexes to attain an adhesive content of up to 20%, by weight, followed by drying. Another method relies on "blowing" a relatively coarse thermoplastic adhesive powder, suspended in air, into the preformed mat using electrostatic assist, followed by a thermal fusing of adhesive particles deposited between the fibers.

As is well known to those skilled in the art, the above-described approaches to making nonwoven products have many inherent disadvantages. Firstly, the preforming of both wet-laid and dry-formed nonwoven webs is several times slower than making of analogous cellulosic webs of similar basis weights on paper machines. Secondly, the fiber lay of raw (unbounded) nonwoven webs is relatively poor to begin with, deteriorating still further when webs are treated with strength-reinforcing adhesives in the subsequent processing step. Thirdly, the composition of furnishes for making both wet-laid and dry-formed nonwoven webs is limited mainly to fibers, no use being made of many valuable functional additives routinely employed in papermaking furnishes. Fourthly, the latex and thermoplastic-powder adhesives used for imparting cohesive strength to nonwoven products are utilized rather wastefully. For example, adequate mechanical strength with latex-saturated nonwoven webs is obtained first when the latex content in the mat reaches about 15-20%, by weight, the powdered adhesives not faring much better.

The above wasteful use of adhesives is readily understood considering that neither the wet saturation with latex nor the electrostatically aided incorporation of adhesive powders is amenable to directing the adhesive particles effectively into strategic locations into, or close to, the fiber/fiber contact areas. As a consequence, the overwhelming proportion of latex is pasted uselessly around the fibers themselves while, similarly, a major proportion of adhesive-powder particles is located too far from the fiber/fiber contact areas to form adhesive joints. Some unique problems are also associated with the use of dry adhesive powders inasmuch as virtually all very fine powders are agglomerating ("sticking") easily, their flow properties being adversely affected. Moreover, as a general rule, very fine particles are not readily amenable to electrostatic deposition. As a consequence, adhesive-powder particles must be much larger (e.g., 20–25 μm e.s.d.) than is necessary for establishing individual adhesive joints between the relatively thin synthetic fibers whose diameters typically range between 10 and 15 μm.

In contrast, the method of the papermaking process of the present invention makes it possible to manufacture novel and improved wet-laid nonwoven products with unique functional properties and material characteristics, not attainable with the aid of the nonwoven-manufacturing technologies of the prior art. The latter advancements are realized by flocculating specially designed multicomponent nonwoven furnishes with the in-situ synthesized complex functional microgels and forming wet-laid nonwoven webs on a paper machine. The above multicomponent furnishes can be incomparably more diversified and complex than furnishes used in the nonwoven-manufacturing technologies of the prior art, comprising, among other things, synthetic fibers; synthetic reinforcing microfibrils; polymer-emulsion adhesives, particularly the previously mentioned novel acrylic ultrafine polymer-emulsion adhesives; novel waterborne rubber cements; aqueous dispersions of fine-particle-size thermoplastic adhesive powders with a preferred average particle diameter of about 0.5 μm; organic dyes; and bioactive materials; the advantages of the above functional additives being explained in more detail hereinafter.

Although, as is readily understood by those skilled in the art, a uniform mat can be made only from a well-dispersed fiber furnish, the inefficient flocculation mechanisms at the foundation of the papermaking processes of the prior art are incapable of overwhelming the action of the powerful modern dispersants. As a consequence, wet-laid nonwoven webs made of more or less nonpolar synthetic fibers, crudely (mechanically) dispersed in aqueous furnishes, are much less uniform than comparable webs (paper) made of distinctly polar cellulosic fibers. Moreover, the inherently poor web-formation quality of prior-art wet-laid nonwovens makes it difficult to increase the present low paper machine speeds, or use longer fibers (yielding stronger webs), in making the latter nonwovens.

In contrast, the overpowering flocculation mechanism at the foundation of the papermaking process of the present invention allows one to use well-dispersed, highly diversified furnish compositions, invariably generating extremely uniform micrograin structures in the flocculated furnishes. Consequently, very uniform wet-laid nonwoven webs can be preformed at considerably higher paper machine speeds, using longer fibers, than are feasible in the nonwoven-making technologies of the prior art.

The manufacture of raw wet-laid nonwoven webs is greatly facilitated by incorporating into the furnish up to 5%, by weight, in relation to furnish solids, of the novel ultrafine polymer-emulsion adhesives and/or novel waterborne rubber cements with pronounced wet-tack properties. The latter adhesives, along with the in-situ synthesized complex functional microgel cements, impart a certain level of instant strength to the raw nonwoven webs, protecting the initial uniform fiber lay from damage during the subsequent latex saturation or blowing-in of thermoplastic adhesive powders.

Since both the polymer-emulsion adhesives and waterborne rubber cements are coflocculated and retained primarily with the discrete deposits of the complex functional microgels embedded strategically between adjacent fibers, the overall adhesive demand in the subsequent latex saturation or incorporation of adhesive powders is substantially reduced. Regardless of the complete flocculation of all particulates, however, it would be impractical to incorporate more than about 5%, by weight, of the novel polymer-emulsion adhesives and/or novel waterborne rubber cements into the furnish in that an excessive concentration of tacky aggregates present in raw wet-laid nonwoven webs could lead to a contamination of paper-machine felts. The logical consequence of the above is that the customary second process stage in making wet-laid nonwoven webs cannot be eliminated as long as latex saturation is the principal vehicle of providing the web strength.

The second process stage in making wet-laid nonwovens can be eliminated completely with the papermaking process of the present invention by incorporating thermoplastic adhesive powers directly into nonwoven furnishes. The adhesive powders in question, employed in the form of fine-particle-size aqueous dispersions, are retained in raw wet-laid nonwoven webs on the forming screen in exactly the same manner as ordinary filler pigments are retained in paper webs, without contaminating paper-machine felts.

In addition to eliminating a second processing step, the principal advantages of the above approach are a better overall material and process economy as well as strategically favorable placement of adhesive particles at the fiber/fiber contact areas. The economic advantage in question is readily apparent considering that about 125,000 particles with a diameter of 0.5 μm, being potentially able of forming 125,000 microadhesive joints, can be obtained from just a single adhesive-powder particle with a diameter of 25 μm. Moreover, adhesive joints between the relatively thin synthetic fibers can be formed more readily with commensurately fine adhesive particles than with excessively coarse ones.

The above-mentioned strategic placement of adhesive particles coaggregated with microgel particles occurs because the aggregates in question migrate with the receding water during the dehydration (drying) of raw wet-laid nonwoven webs. Since the very last pockets of water within dehydrating webs are confined to capillaries formed by fiber/fiber intersections, adhesive joints are automatically established after an appropriate heat treatment of the dehydrated webs.

Another advantage of applying the papermaking process of the present invention to the manufacture of wet-laid nonwoven webs is that uniformly colored nonwoven products can be obtained economically by incorporating organic dyes directly into wet-laid-nonwoven furnishes. It is important, however, to simultaneously incorporate the novel ultrafine acrylic polymer-emulsion adhesives and/or waterborne rubber cements into the latter furnishes to effectively immobilize the dyes retained in nonwoven webs. On the other hand, as is well known to those skilled in the art, the flocculation and retention of organic dyes is largely impractical in prior-art processes for making wet-laid nonwoven products.

Attractive, novel, uniquely strong nonwoven products can be obtained with the aid of the papermaking process of the present invention from furnishes containing well-dispersed synthetic fibers, reinforcing synthetic microfibrils, ultrafine acrylic polymer-dispersion adhesives and/or waterborne rubber cements, as well as the previously mentioned aqueous dispersions of fine-particle-size thermoplastic adhesive powders. Freshly formed (raw) nonwoven webs formulated in the above manner, unlike raw nonwoven webs of the prior art, have a considerable "green" strength (the latter term, borrowed from the ceramic technology, refers to the strength of a yet unbounded, or only partially bounded, raw mat), thus can be readily laminated with the aid of cylinder-board machines or multiple-Fourdrinier machines to yield even stronger, more versatile novel nonwoven products capable of successfully competing with a broad range of conventional woven fabrics. The lamination process can be facilitated by applying sprays of aqueous dispersions of thermoplastic adhesive powders onto the surface of freshly formed individual raw wet-laid nonwoven webs before the latter are wound into multilayer composites.

As is well known to those skilled in the art, hygroscopic properties are most desirable with nonwoven products intended for body contact, while intrinsic biostatic or biocidal properties are desirable with many nonwoven products intended for use in hospitals, biological laboratories and for related applications. In making the above products in accordance with the prior art, the functional properties under discussion must be imparted to nonwoven products by way of special, separate aftertreatments. In contrast, a certain level of intrinsic hygroscopic properties is imparted automatically to wet-laid nonwoven products made with the aid of the in-situ synthesized complex microgels, by virtue of these microgels' pronouncedly polar nature, while yet higher levels of hygroscopic properties are obtained by adding hydrophilic anionic or nonionic polymers directly to wet-laid-nonwoven furnishes or by adding hydrophilic cationic polymers to the solutions of calcium chloride or equivalent cross-linking salts. Biostatic and/or biocidal properties can similarly be imparted to wet-laid non-woven products by adding suitable biostatic and/or biocidal materials into wet-laid-nonwoven furnishes.

The papermaking process of the present invention is also uniquely suitable for manufacturing wet-laid nonwoven webs resistant to high temperatures, using furnishes comprising thermally resistant inorganic fibers. In making the above products it is often advantageous to simultaneously employ polymer-emulsion adhesives in the furnish to improve the green strength of the resultant raw wet-laid nonwoven webs and then burn off the adhesives by way of calcining.

The papermaking process of the present invention is also uniquely suited for the manufacture of novel electroconductive and/or magnetic paper, board and wet-laid nonwoven products by incorporating aqueous dispersions of ultrafine powders (with particles finer than 0.2 μm e.s.d.) of metallic or ceramic electroconductive materials, or ceramic or metallic (alloyed) magnetic materials (e.g., supermalloy or permalloy), into paper, board and wet-laid-nonwoven furnishes, in proportions of from 0.1% to 20% (active), by weight, of furnish solids. For example, paper and wet-laid nonwoven webs containing intrinsically deposited magnetic powders are uniquely suited for printing of counterfeit-proof, virtually indestructible (when made of nonwovens) banknotes, the magnetic response of such banknotes being measurable quickly and conveniently with the aid of inexpensive countertop detectors.

The paper (nonwoven) process of the present invention may be executed in actual paper mill operations in several different fashions. In a preferred approach, paper, board or wet-laid-nonwoven furnishes are flocculated with the aid of in-situ synthesized complex functional microgels immediately before entering the chest or after leaving the chest on the way to the headbox. To manufacture groundwood-containing paper, hydrogen peroxide is preferably incorporated into the furnish prior to, or simultaneously with, the addition of the highly alkaline solutions of sodium silicate and sodium aluminate (zincate).

The most preferable approach is to carry out the furnish flocculation in a fully continuous mode, using in-line mixers-reactors, exemplified by the following consecutive steps:

(a) continuously injecting, in the first processing station, separate streams of aqueous solutions of sodium silicate and sodium aluminate (sodium zincate or blends of sodium aluminate and sodium zincate) into an in-line-agitated stream of paper, board or wet-laid-nonwoven furnishes to form, in situ, a transient chemically reactive subcolloidal hydrosol;

(b) continuously injecting, in the second processing station, an aqueous solution of calcium chloride or equivalent bivalent or multivalent cross-linking salt(s), optionally containing organic cationically active compound(s) with at least two reactive groups in each molecule as the auxiliary cross-linking salt(s), into the furnish stream resulting from step (a) to cross-link said subcolloidal hydrosol and synthesize, in situ, complex functional microgel cements, whereupon said paper, board or wet-laid-nonwoven furnish becomes flocculated instantaneously, indiscriminately and completely;

(c) optionally, continuously purging the flocculated furnish resulting from step (b) of dissolved contaminants; and (d) continuously recovering the flocculated furnish resulting from steps (b) and (c) to manufacture paper, board and other wet-laid products on a paper machine.

In another version of the above continuous process mode the stream of furnish is first divided into two separate halfstreams, the solution of sodium silicate being injected into one halfstream and the solution of sodium aluminate, sodium zincate or blends thereof into the other. Both above halfstreams are recombined in the subsequent processing station (in-line mixer-reactor) to form, in situ, the transient chemically reactive subcolloidal hydrosol, the solution of the cross-linking agent(s) being injected into the recombined halfstreams in the subsequent processing station to form, in situ, the complex functional microgel cements.

As is understood readily by those skilled in the art, the sequence of the individual processing steps in the general process of the present invention may be reversed by adding solutions of bivalent and/or multivalent inorganic cross-linking salts to the furnish in step (a); separately preparing the transient reactive subcolloidal sodium-silico-aluminate or similar hydrosols in step (b); and blending in step (c) the systems resulting from steps (a) and (b) to form in situ a complex functional calcium-silico-aluminate or similar microgel cement and flocculate the furnish instantaneously, indiscriminately and completely, thus obtaining a medium suitable for making paper, board and other wet-laid products on a paper machine. Such a reversal of the sequence of the processing steps is recommended only in such instances, however, in which the colloidal stability of paper, board or wet-laid-nonwoven furnishes is not intolerably impaired by the action of the bivalent and/or multivalent inorganic cross-linking salts during the interval preceding the introduction of the previously mentioned, separately prepared transient chemically reactive subcolloidal hydrosol into the furnish. Although the overall results obtained by the above approach are as a rule better than can be obtained with the aid of prior-art acidic and alkaline papermaking processes, the principal process version of the present invention, in which the subcolloidal hydrosols are formed in situ (in the furnish) in the first step and then cross-linked in the second step, is decidedly superior and preferable.

While certain preferred practices and embodiments of this invention have been set forth in the foregoing specification, it is understood by those skilled in the art that other variations and modifications may be employed within the scope of the teachings of the present invention. The detailed description is, therefore, not to be taken in a limiting sense and the scope of the present invention is best defined by the claims to follow.

What is claimed is:

1. A process for the manufacture of paper, board and other wet-laid products under pH conditions ranging from 4.5 to 12.0, from aqueous furnishes comprising at least one kind of fibers selected from the group consisting of cellulosic fibers, synthetic organic fibers and inorganic fibers, said furnishes being treated with in-situ-synthesized complex functional microgel cements, retained in said products in proportions of from 0.4 to 10.0%, by weight, as determined by ashing, comprising the steps of:

(a) preparing, in situ, a transient chemically reactive subcolloidal hydrosol by blending with said furnishes two separate solutions, one of which comprises at least one reagent selected from the group consisting of alkali-metal silicates and quaternary ammonium silicates, employed in proportions of from 0.2% to 5.0%, by weight, of furnish solids, and the other of which comprises at least one reagent selected from the group consisting of alkali-metal aluminates and alkali-metal zincates, employed in proportions of from 0.2% to 5.0%, by weight, of furnish solids, wherein the ratio of said silicates to said aluminates, zincates or blends thereof is from 1:10 to 10:1, by weight;

(b) blending an aqueous solution comprising at least one cross-linking agent selected from a first group consisting of bivalent and multivalent inorganic salts, employed in proportions of from 0.4% to 10.0%, by weight, of furnish solids, said aqueous solution optionally comprising one or more additional cross-linking agent(s) selected from a second group consisting of organic, cationically active chemical compounds with at least two reactive groups in each molecule, employed in a proportion of up to 0.5%, by weight, of furnish solids, with the furnishes resulting from step (a) to cross-link said in-situ-formed transient chemically reactive subcolloidal hydrosol and synthesize in situ said complex functional microgel cements, whereupon said furnishes flocculate instantaneously, indiscriminately and completely;

(c) optionally purging said flocculated furnishes resulting from step (b) of dissolved contaminants; and (d) recovering said flocculated furnishes resulting from steps (b) and (c) to form paper, board or other wet-laid products on a paper machine.

2. The process according to claim 1, wherein said furnishes optionally comprise one or more one of the following materials in proportions specified below in relation to furnish solids:

(a) filler pigments, up to more than 50%, by weight;

(b) color dyes, up to 5.0%, by weight;

(c) carbon black, deagglomerated by the masterbatch method, up to 0.1%, by weight;

(d) latex adhesives with an average particle diameter larger than 70 nm, up to 5.0%, by weight;

(e) ultrafine acrylic polymer-emulsion adhesives with an average particle diameter smaller than 55 nm and a glass-transition temperature ranging from −60° C. to +20° C., up to 5.0%, by weight;

(f) waterborne acrylic rubber cements, up to 5.0%, by weight;

(g) waterborne disperse thermoplastic adhesives, up to 20.0%, by weight;

(h) water-soluble adhesives, up to 2.0%, by weight;

(i) synthetic microfibrils, up to 2.0%, by weight;

(j) cellulosic microfibrils with a length of from 10 μm to 200 μm, prepared extraneously by the cascade microfibrillation process, up to 2.0%, by weight; and (k) ultrafine electroconductive and/or magnetic ceramic and/or metallic powders with particle diameters finer than 0.2 μm, up to 20%, by weight.

3. The process according to claim 1, wherein aqueous solutions of said organic, cationically active chemical compounds with at least two reactive groups in each molecule are employed as an aftertreatment, by blending said aqueous solutions with furnishes already flocculated by said in-situ synthesized complex functional microgel cements.

4. The process according to claim 1, wherein said at least one reagent selected from the group consisting of sodium and potassium silicates and quaternary ammonium silicates is employed in said furnishes at a concentration of from 0.01% to 2.0%, by weight.

5. The process according to claim 1, wherein said at least one reagent selected from the group consisting of sodium and potassium aluminates and sodium and potassium zincates is employed in said furnishes at a concentration of from 0.01% to 2.0%, by weight.

6. The process according to claim 1, wherein said at least one bivalent or multivalent inorganic cross-linking salt selected from the group consisting of water-soluble, essentially colorless salts of calcium, magnesium, barium, aluminum, zinc and zirconium is employed in said furnishes at a concentration of from 0.02% to 4.0%, by weight.

7. The process according to claim 1, wherein said at least one organic cationically active chemical compound with at least two reactive groups in each molecule, selected from the group consisting of cationic surface active agents, organometallic Werner complexes and cationic polyelectrolytes, is employed in said furnishes at a concentration of up to 0.15%, by weight.

8. The process according to claim 2, wherein said extraneously prepared cellulosic microfibrils with a length of from μm to 200 μm are made from cellulosic fibers by the cascade microfibrillation process comprising the steps of:

(a) chopping said cellulosic fibers to a length preventing hydraulic spinning in the subsequent refining operations;

(b) refining an aqueous dispersion of said chopped fibers from step (a) at a solids concentration of up to 35%, by weight;

(c) additionally refining said aqueous dispersion of fibers resulting from step (b) with the aid of centrifugal comminutors; and (d) finalizing said cascade microfibrillation process with the aid of homogenizers in which said aqueous disperson of refined fibers resulting from step (c) is compressed at very high pressures and then rapidly decompressed, by passing through a nozzle, causing the residual bundles of fibrils to explosively separate into individual microfibrils.

9. The process for the manufacture of paper, board and other wet-laid products from aqueous furnishes according to claim 1, wherein the process is performed in a continuous mode in which step (a) is performed by injecting two separate streams of aqueous solutions of subcolloidal-hydrosol-forming reagents into an in-line-agitated stream of said furnishes, to form said transient chemically reactive subcolloidal hydrosols, said one stream comprising at least one reagent selected from the group consisting of alkali-metal silicates and quaternary ammonium silicates and said other stream comprising at least one reagent selected from the group consisting of alkali-metal aluminates and alkali-metal zincates;

step (b) is performed by injecting into the in-line-agitated stream of said furnishes resulting from step (a) an aqueous solution of at least one cross-linking agent selected from a first group consisting of bivalent and multivalent inorganic salts, said aqueous solution optionally comprising one or more additional cross-linking agent selected from a second group consisting of organic cationically active chemical compounds with at least two reactive groups in each molecule, to cross-link said subcolloidal hydrosol and synthesize, in situ, said complex functional microgel cements, whereupon said furnishes become flocculated instantaneously, indiscriminately and completely;

optional step (c) is performed by purging said flocculated furnishes resulting from step (b) of dissolved contaminants; and step (d) is performed by recovering said flocculated furnishes resulting from steps (b) and (c) to form paper, board and other wet-laid products on a paper machine.

10. A process for the manufacture of paper, board and other wet-laid products under pH conditions ranging from 4.5 to 12.0, from aqueous furnishes comprising fibers selected from the group consisting of cellulosic fibers, synthetic organic fibers and inorganic fibers, said furnishes being treated with in-situ-synthesized complex functional microgel cements, retained in said products in proportions of from 0.4% to 10%, by weight, as determined by ashing, comprising the steps of:

(a) blending into said furnishes an aqueous solution comprising at least one cross-linking agent selected from a first group consisting of bivalent and multivalent inorganic salts, used in proportions of from 0.4% to 10.0%, by weight, of furnish solids, said aqueous solution comprising optionally at least one additional cross-linking agent selected from a second group consisting of organic cationically active compounds with at least two reactive groups in each molecule, employed in a proportion of up to 0.5%, by weight, of furnish solids;

(b) preparing, separately, a transient chemically reactive subcolloidal hydrosol by blending an aqueous solution of at least one reagent selected from the group consisting of alkali-metal silicates and quaternary ammonium silicates, employed in a proportion of from 0.2% to 5%, by weight, of furnish solids, with an aqueous solution of at least one reagent selected from the group consisting of alkali-metal aluminates and alkali-metal zincates, employed in a proportion of from 0.2% to 5.0%, by weight, of furnish solids, wherein the ratio of said silicates to said aluminates, zincates or blends thereof is from 1:10 to 10:1;

(c) blending said furnishes resulting from step (a) with said transient chemically reactive subcolloidal hydrosol resulting from step (b) to synthesize, in situ, said complex functional microgel cements, whereupon said furnishes flocculate instantaneously, indiscriminately and completely;

(d) optionally purging said flocculated furnishes resulting from step (c) of dissolved contaminants; and (e) recovering said flocculated furnishes resulting from steps (c) and (d) to form paper, board and other wet-laid products on a paper machine.

* * * * *